US010627751B2

(12) United States Patent
Hasegawa et al.

(10) Patent No.: US 10,627,751 B2
(45) Date of Patent: Apr. 21, 2020

(54) IMAGE HEATING APPARATUS

(71) Applicant: CANON KABUSHIKI KAISHA, Tokyo (JP)

(72) Inventors: Mitsuru Hasegawa, Tsukubamirai (JP); Akiyoshi Shinagawa, Kasukabe (JP); Asuna Fukamachi, Kashiwa (JP); Suguru Takeuchi, Funabashi (JP); Hiroki Kawai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/434,255

(22) Filed: Jun. 7, 2019

(65) Prior Publication Data

US 2019/0377287 A1 Dec. 12, 2019

(30) Foreign Application Priority Data

Jun. 8, 2018 (JP) ..... 2018-110234
Jun. 8, 2018 (JP) ..... 2018-110235

(51) Int. Cl.
*G03G 15/20* (2006.01)

(52) U.S. Cl.
CPC ..... *G03G 15/2039* (2013.01); *G03G 15/2021* (2013.01)

(58) Field of Classification Search
CPC ..... G03G 15/2021; G03G 15/2039
See application file for complete search history.

(56) References Cited

U.S. PATENT DOCUMENTS 8,918,003 B2 12/2014 Kawai et al.
8,929,762 B2 * 1/2015 Shinagawa ..... G03G 15/2032 399/329
9,372,450 B2 * 6/2016 Kitagawa ..... G03G 15/205
2012/0027444 A1 * 2/2012 Kitagawa ..... G03G 15/2032 399/69

FOREIGN PATENT DOCUMENTS

JP H11-194647 A 7/1999
JP 2003-167474 A 6/2003

* cited by examiner

*Primary Examiner* — Gregory H Curran
(74) *Attorney, Agent, or Firm* — Venable LLP

(57) ABSTRACT

An image heating apparatus includes a fixing member, a pressing member, a fan, and a controller. When a mixed job including a first image forming step for continuously forming images on recording materials having a first basis weight and including a second image forming step, subsequent to the first image forming step, for continuously forming the images on recording materials having a second basis weight is executed, the controller switches, before a final recording material in the first image forming step completely passes through the nip, the operation of the fan to an operation of the fan for making a temperature of the pressing member higher than the temperature of the pressing member when the images are formed on the recording materials having the first basis weight.

20 Claims, 20 Drawing Sheets

| RECORDING PAPER BASIS WEIGHT | EVALATION ITEMS | PRESSING ROLLER TEMPERATURE | | | | | |
|---|---|---|---|---|---|---|---|
| | | 70°C | 80°C | 90°C | 100°C | 110°C | 120°C |
| 68g/m2 | BLISTER | ○ | ○ | ○ | △ | × | × |
| | COLD OFFSET | ○ | ○ | ○ | ○ | ○ | ○ |
| 104g/m2 | BLISTER | ○ | ○ | ○ | ○ | ○ | × |
| | COLD OFFSET | × | × | ○ | ○ | ○ | ○ |
| 300g/m2 | BLISTER | ○ | ○ | ○ | ○ | ○ | ○ |
| | COLD OFFSET | × | × | × | × | ○ | ○ |

FIG.6

| RECORDING PAPER BASIS WEIGHT | PRESSING ROLLER TARGET TEMPERATURE | |
|---|---|---|
| | TL | TU |
| 60-80g/m$^2$ | 70°C | 90°C |
| 81-120g/m$^2$ | 90°C | 110°C |
| 121-220g/m$^2$ | 100°C | 120°C |
| 221-300g/m$^2$ | 110°C | 130°C |

FIG.7

| | | ROLLER TEMP. (TU OR TL) AFTER SWITCH | | | | |
|---|---|---|---|---|---|---|
| | | 80°C | 90°C | 100°C | 110°C | 120°C |
| ROLLER TARGET TEMP. (Tb') BEFORE SWITCH | 80°C | 0sec | 5sec | 10sec | 15sec | 20sec |
| | 90°C | 5sec | 0sec | 5sec | 10sec | 15sec |
| | 100°C | 10sec | 5sec | 0sec | 5sec | 10sec |
| | 110°C | 15sec | 10sec | 5sec | 0sec | 5sec |
| | 120°C | 20sec | 15sec | 10sec | 5sec | 0sec |

| CORRECTION TEMP. : p | | SUBSEQUENT JOB SHEET NUMBER | | |
|---|---|---|---|---|
| | | 0~5 | 6~10 | 11~ |
| SUBSEQUENT PAPER BASIS WEIGHT | 68g/m$^2$ | 3 | 0 | 0 |
| | 104g/m$^2$ | 5 | 0 | 0 |
| | 300g/m$^2$ | 10 | 5 | 0 |

| | PRESSING ROLLER SURFACE TEMP. | PASSING PAPER BASIS WEIGHT |
|---|---|---|
| STATE 1 | ≤60°C | 68-105g |
| | ≤50°C | 106-210g |
| | ≤40°C | 211-300g |
| STATE 2 | 60~85°C | 68-105g |
| | 50~75°C | 106-210g |
| | 40~65°C | 211-300g |
| STATE 3 | 85°C≤ | 68-105g |
| | 75°C≤ | 106-210g |
| | 65°C≤ | 211-300g |

| COMP.EX.3 | | COMP.EX.4 | | EMB.2 | | |
|---|---|---|---|---|---|---|
| NON-PASSING PORTION TEMP. | BLISTER RANK | NON-PASSING PORTION TEMP. | BLISTER RANK | NON-PASSING PORTION TEMP. | BLISTER RANK | SHEET NUMBER OF JOB 2 |
| 222°C | RANK2 | 237°C | RANK3 | 225°C | RANK3 | 1ST |
| | RANK2 | | RANK3 | | RANK3 | 2ND |
| | RANK1 | | RANK3 | | RANK3 | 3RD |
| | RANK1 | | RANK3 | | RANK3 | 4TH |
| | RANK1 | | RANK3 | | RANK3 | 5TH |

IMAGE HEATING APPARATUS

FIELD OF THE INVENTION AND RELATED ART

The present invention relates to an image heating apparatus for use with an image forming apparatus, such as a copying machine, a printer or a facsimile machine, employing, for example, an electrophotographic type and capable of forming an image on the recording material.

In recent years, printing of commercial printed matter such as catalogs, posters and pamphlets depending on a necessary number of copies, and an on-demand printing market in which continuous direction is carried out while changing, for each of customers, a part of printing contents of various bills, direct mails and the like increase. For that reason, in place of offset printing requiring plate making, also in the on-demand printing market, the image forming apparatus of the electrophotographic type is in the limelight.

Further, as regards such an image forming apparatus, in order to meet speed-up, a belt fixing device as the image heating apparatus has been employed. That is, as the belt fixing device, a fixing belt and a pressing roller are used, so that a fixing nip which is a heating region long in a feeding direction of the recording material (recording paper) can be formed, and thus high productivity can be achieved even on recording paper having a large basis weight exceeding 300 $g/m^2$.

In addition, thereto, in recent years, even in the case where sheets of recording paper different in basis weight are used in mixture, such a function that fixing and feeding are carried out with no waiting time has been strongly required. In this case, at a fixing temperature capable of satisfying a fixing property of the recording paper exceeding 300 $g/m^2$, as a subsequent job, recording paper having a small basis weight such as 60 $g/m^2$ is also used for fixing. When a heat quantity is excessive on the recording paper with the small basis weight, principally in coated paper or the like with the small basis weight, there is a possibility that a phenomenon which is called blister occurs. This is a phenomenon that by excessive heating, water content of original paper in the coated paper becomes water vapor, and this water vapor passes through a weak portion of a coated layer and goes out.

Further, in the case where the fixing temperature is set at an optimum fixing temperature for the recording material with the small basis weight such as 60 $g/m^2$, the heat quantity is insufficient for the recording paper exceeding 300 $g/m^2$, so that there is a possibility that cold offset occurs.

Therefore, in order to minimize a waiting time during use of the sheets of recording paper in mixture while changing the heat quantity applied for each of the different sheets of recording paper, control of the heat quantity applied from the pressing roller as a rotatable pressing member toward the recording paper while keeping a target temperature of the fixing belt at a certain value to the extent possible is effective. As such a fixing device, a constitution in which a heat source for pressing roller is suppressed (Japanese Laid-Open Patent Application (JP-A) Hei 11-194647) and such a constitution that a pressing roller is cooled (JP-A 2003-167474) have been proposed.

Here, a target temperature range of the pressing roller suitable for suppressing an occurrence of an image defect due to the blister and the cold offset is different every basis weight of the recording paper. Accordingly, in the case where the recording paper subjected to a fixing process is changed from recording paper with a small basis weight to recording paper with a large basis weight, a pressing roller temperature is required to be changed from a temperature suitable for the recording paper with the small basis weight to a temperature suitable for the recording paper with the large basis weight until the time when the recording paper with the large basis weight reaches the fixing device.

Therefore, when a recording material with a first basis weight and a recording material with a second basis weight are used in mixture for image formation, when a constitution in which preparation of heating of an image on the recording material with the second basis weight is carried out after heating of the image on the recording material with the first basis weight is ended is employed, a waiting time becomes long, so that there is a liability that productivity lowers.

SUMMARY OF THE INVENTION

A principal object of the present invention is to provide a fixing device (image heating apparatus) capable of suppressing a lowering in productivity when heating of images on recording materials with different recording materials is continuously carried out.

According to an aspect of the present invention, there is provided an image heating apparatus for heating an image on a recording material, comprising: a fixing member including a heating portion and configured to fix a toner image on the recording material in contact with the toner image formed on the recording material; a pressing member configured to form a nip in cooperation with the fixing member; a fan configured to cool the pressing member; and a controller configured to control an operation of the fan, wherein a temperature of the pressing member when the image is formed on a recording material having a first basis weight is lower than a temperature of the pressing member when the image is formed on a recording material having a second basis weight larger than the first basis weight, wherein when a mixed job including a first image forming step for continuously forming images on recording materials having the first basis weight and including a second image forming step, subsequent to the first image forming step, for continuously forming the images on recording materials having the second basis weight is executed, the controller switches, before a final recording material in the first image forming step completely passes through the nip, the operation of the fan to an operation of the fan for making the temperature of the pressing member higher than the temperature of the pressing member when the images are formed on the recording materials having the first basis weight.

Further features of the present invention will become apparent from the following description of exemplary embodiments with reference to the attached drawings.

BRIEF DESCRIPTION OF THE DRAWINGS

FIG. 6 is a table showing an experimental result regarding a blister and cold offset.

FIG. 7 is a table showing a recording paper basis weight, and a lower limit temperature TL and an upper limit temperature TU of a target temperature range of a pressing roller.

DESCRIPTION OF EMBODIMENTS

Embodiments of the present invention will be described with reference to the drawings.

First Embodiment (Image Forming Apparatus)

Figure 1:
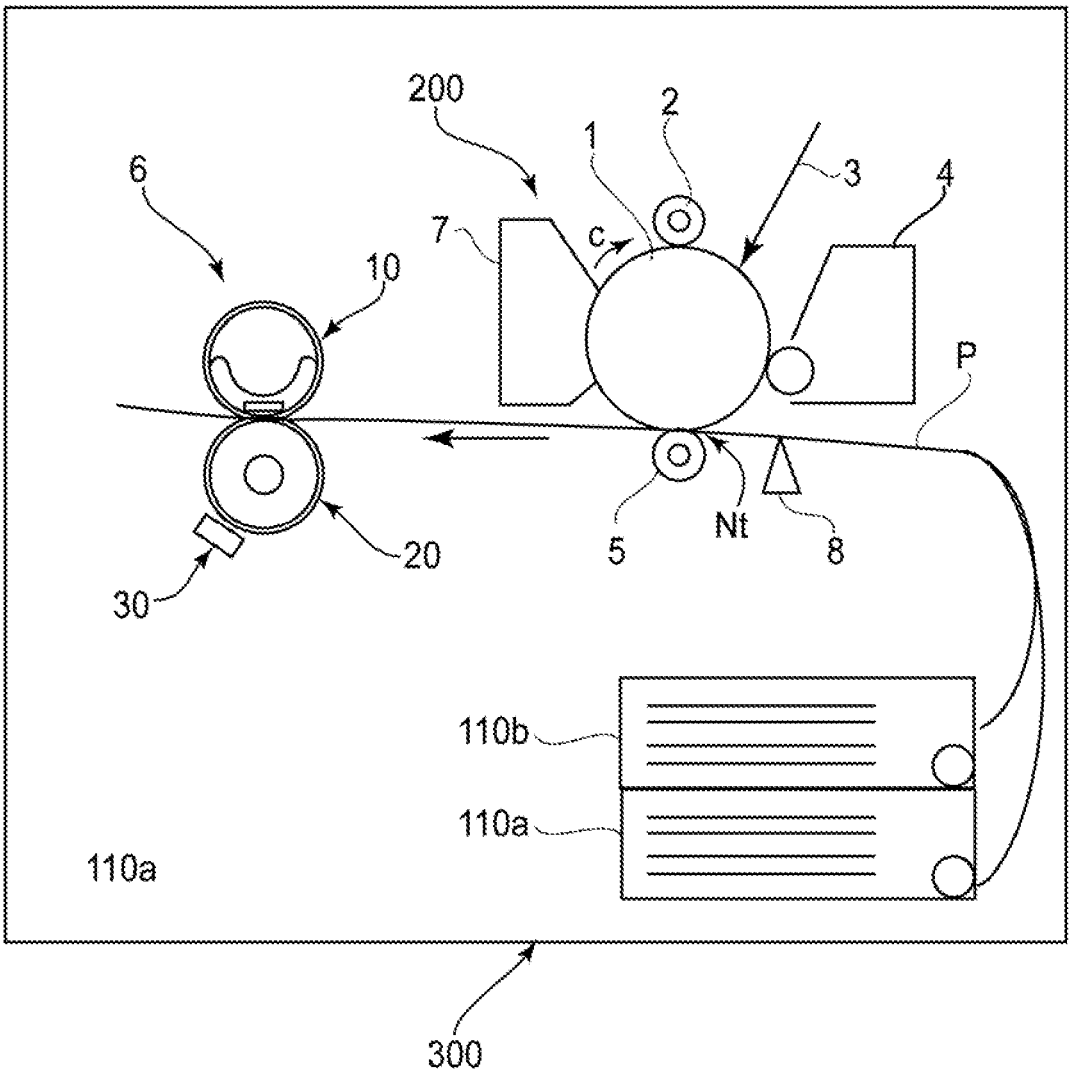
FIG. 1 is a schematic view of an image forming apparatus in which a fixing device as an image heating apparatus according to First Embodiment is mounted.

FIG. 1 is a schematic view of a general structure of an image forming apparatus 300 in which a fixing device according to this embodiment is mounted. In FIG. 1, an image forming portion 200 include a drum-shaped electrophotographic photosensitive member (hereinafter referred to as a photosensitive drum) 1 which is an image bearing member. The photosensitive drum 1 is prepared by forming a photosensitive material such as OPS, amorphous Se, amorphous Si or the like on a cylindrical substrate of aluminum, nickel or the like. The photosensitive drum 1 is rotationally driven in a direction of an arrow c, and a surface thereof is electrically charged by a charging roller 2 as a charging device.

Then, the photosensitive drum surface is subjected to scanning exposure to a laser beam 3 ON/OFF-controlled depending on image information, so that an electrostatic latent image is formed. This electrostatic latent image is developed and visualized by a developing device 4. As a developing method, a jumping developing method, a two-component developing method, FEED developing method and the like are used, and this developing method is used in combination with image exposure and reverse development in many cases.

Recording materials (sheets of recording paper) P different in basis weight from each other are accommodated in sheet (paper) feeding cassettes 110*a* and 110*b*. Further, as regards the fed recording material (recording paper) P, a leading end thereof is detected by a top sensor 8 provided on a side upstream of a transfer nip Nt with respect to a recording material feeding direction, and is conveyed toward the transfer nip Nt while being synchronized with a toner image visualized on the photosensitive drum 1. The toner image on the photosensitive drum 1 is transferred from the photosensitive drum 1 onto the recording material P conveyed to the transfer nip Nt, by a transfer roller 5 as a transfer device. At this time, the recording material P is nipped and conveyed at a certain pressure (pressing force) by the photosensitive drum 1 and the transfer roller 5.

Then, the recording material on which the toner image is transferred is conveyed to a fixing device 6, and the toner image is fixed as a fixed image. On the other hand, transfer residual toner remaining on the photosensitive drum 1 is removed from the surface of the photosensitive drum 1 by a cleaning device 7.

In FIG. 1, 10 represents a fixing member as a first rotatable member, 20 represents a pressing roller which is an elastic pressing member (for pressing (urging) the first rotatable member) as a second rotatable member, and 30 represents a cooling device for cooling the pressing roller 20, and these will be described later specifically.

(Fixing Device)

Figure 2:
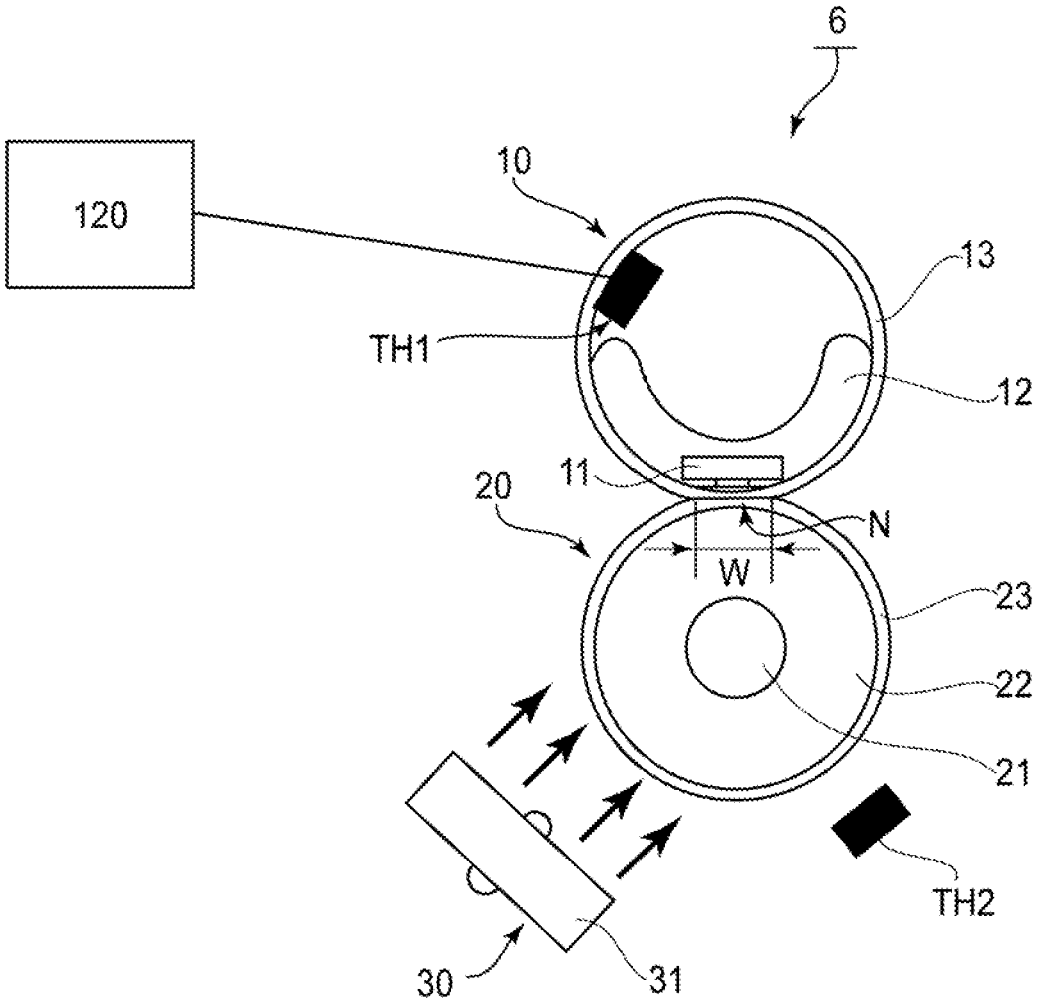
FIG. 2 is a cross-sectional view of the fixing device according to the First Embodiment.
Figure 3:
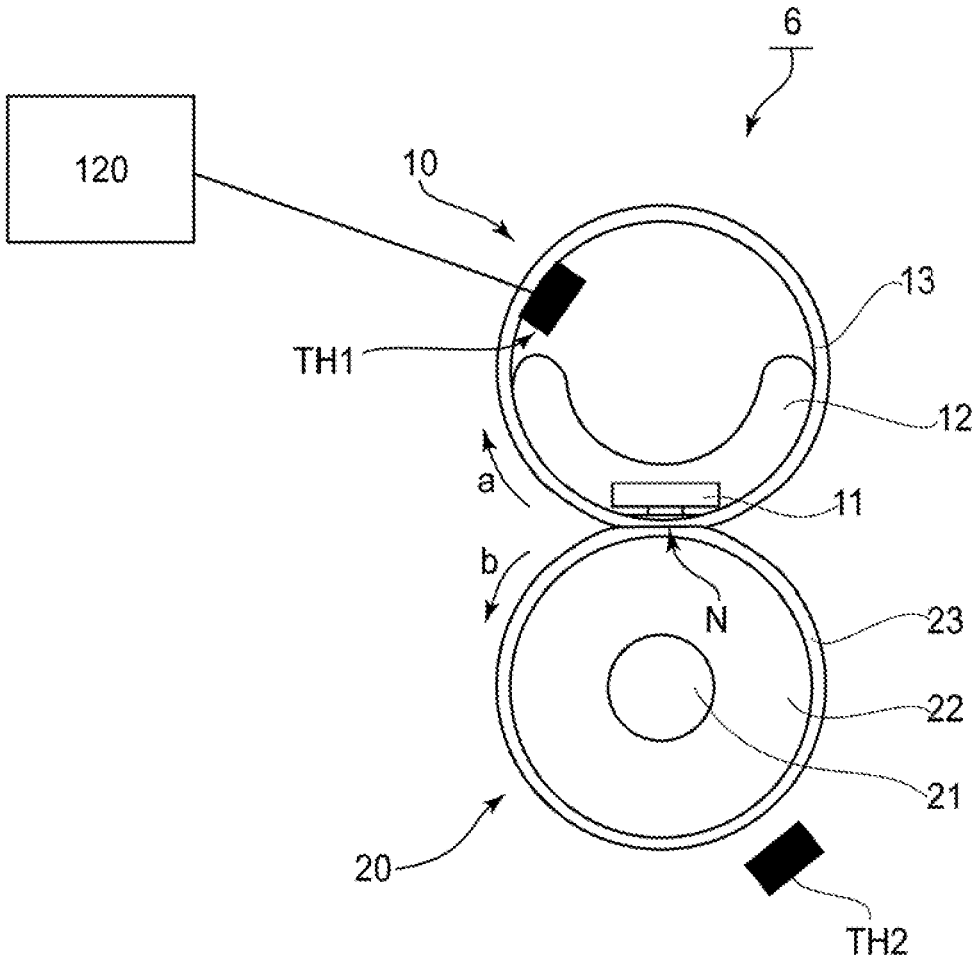
FIG. 3 is a cross-sectional view of the fixing device according to the First Embodiment.

FIGS. 2 and 3 are schematic structural views of the fixing device 6 as an image heating apparatus in this embodiment. In the following description, with respect to fixing members constituting the fixing device, a longitudinal direction is a direction perpendicular to a recording material feeding direction and a recording material thickness direction, and a widthwise (short side) direction is a direction perpendicular to the longitudinal direction and the recording material thickness direction.

As shown in FIG. 2, the fixing member 10 as the first rotatable member and the pressing roller 20 as the second rotatable member form a fixing nip N, with a predetermined nip width W, in which the recording material is nipped and conveyed in cooperation. Further, the fixing device 6 includes a heater 11 as a heating member for heating the nip. The heater 11 is held by a heater holder 12 and is provided inside a fixing belt (image heating belt) 13, and heat-melts and fixes an unfixed toner image (unheated (image) toner image) on the recording material introduced into the nip N through the fixing belt 13.

Then, energization to the heater 11 is controlled by a main assembly controller 120 (described later with regard to FIG. 5) including a temperature controller so that a detection temperature of a temperature sensor TH1 as a temperature information acquiring means (image detecting means) such as a thermistor contacting an inner surface of the fixing belt 13 is a predetermined fixing temperature.

Figure 4:
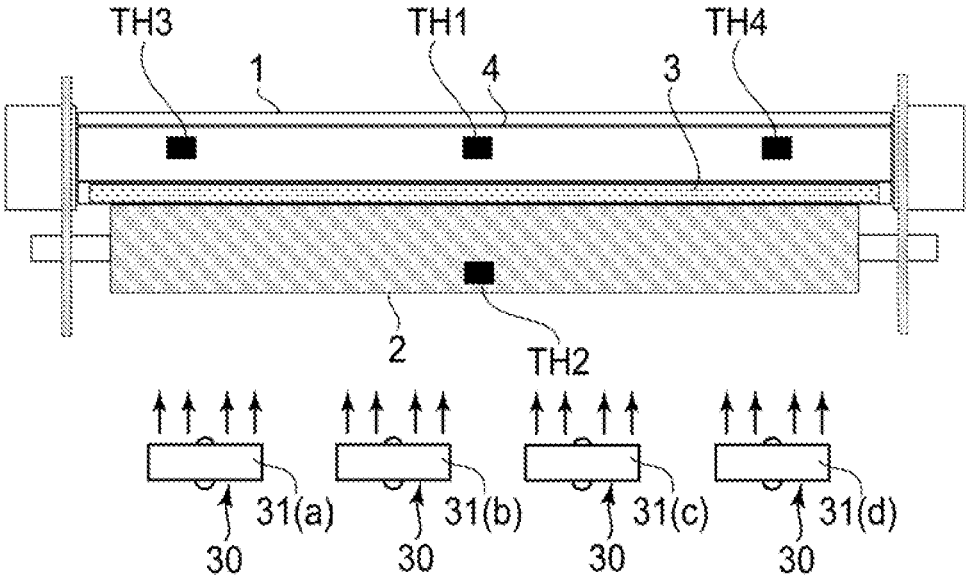
FIG. 4 is a longitudinal sectional view of the fixing device according to the First Embodiment.

As regards the pressing roller 20 opposing the fixing belt 13, from an inside, a core metal 21, an elastic layer 22 and a parting layer 23 are provided, and a central portion temperature of the pressing roller cooled by a cooling device 30 including a fan 31 with respect to a longitudinal direction of the pressing roller is detected by a temperature sensor TH2 (FIG. 4).

As regards the fixing belt 13, the fixing belt 13 is a cylindrical or endless belt-shaped or a rolled non-endless web-shaped member, and is intimately contacted to and slid on the heater 11 surface in the nip N by an unshown driving means or a rotational force of the pressing roller 20. Then, the fixing belt 13 is conveyed and moved in a direction of an arrow a (FIG. 3).

The fixing belt 13 is a heat-resistant belt small in heat capacity and comprises a film, of polyimide, polyamideimide, PEEK, PFA, PTFE or the like, which is 100 μm or less in thickness and which has a heat-resistant property and a thermoplastic property. There is a need to have a sufficient strength for contacting the fixing device 6 having a long lifetime and to have a thickness of 20 μm or more as a belt excellent in durability. Accordingly, as the thickness of the fixing belt 13, 20 μm or more and 100 μm or less are optimum. In this embodiment, polyimide of 80 μm in thickness was used.

On a surface layer of the fixing belt 13, in order to prevent offset and to ensure a separating property of the recording material, a heat-resistant resin, such as PFA, PTFE, FEP or silicone resin, good in parting property is coated in mixture or alone.

The heater holder 12 holding the heater 11 is constituted by a heat insulating member for preventing heat dissipation in a direction opposite to a direction of approaching the nip N, and for example, a liquid crystal polymer, phenolic resin, PPS, PEEK or the like is used. With the heater holder 12, the fixing film 13 (belt) is loosely fitted externally with a margin, and the heater holder 12 is disposed so that the fixing film (belt) 13 is freely rotatable in the direction of the arrow a (FIG. 3).

Between the heater 11 for heating and the heater holder 12, and the fixing belt 13, heat-resistant grease is interposed in a small amount. The heat-resistant grease has the function of decreasing a frictional resistance between the heater 11 for heating and the heater holder 12, and the fixing belt 13, and makes rotation of the fixing belt 13 smooth.

Figure 5:
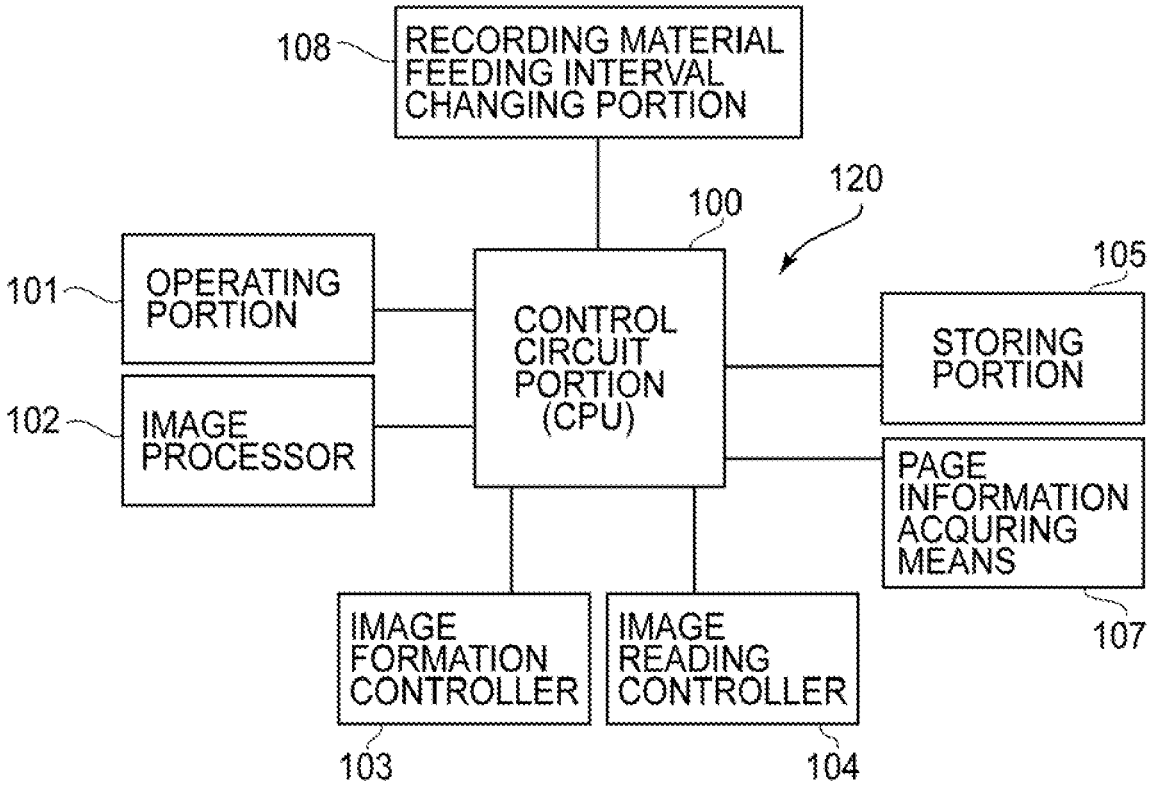
FIG. 5 is a block diagram of a main assembly controller in the image forming apparatus in which the fixing device according to the First Embodiment is mounted.

The temperature sensor TH1 is provided in contact with the fixing belt 13 at a central portion and an inner surface portion position of the fixing belt 13 with respect to a longitudinal direction (widthwise direction) of the fixing belt 13. This temperature sensor TH1 detects a temperature of a region which is a sheet-passing region of the fixing belt 13, and detected temperature information thereof is fed back to a control circuit portion (controller, CPU) 100 included in the main assembly controller 120 (FIG. 5).

The control circuit portion 100 controls electric power to be inputted to the heater 11 so that a detection temperature to be inputted from the temperature sensor TH1 is maintained at a predetermined target temperature (fixing temperature). Also as temperature sensors TH3 and TH4, similarly as the temperature sensors TH1 and TH2, thermistors are used, and as shown in FIG. 4, a temperature of a non-sheet-passing region of recording paper is detected, and detected temperature information is sent to the control circuit portion 100.

As regards the pressing roller 20, outside the core metal 21, the elastic layer formed of a heat-resistant rubber, such as a silicone rubber or a fluorine-containing rubber or formed by foaming the silicone rubber is provided, and on this elastic layer, the parting layer 23 of PFA, PTFE, FEP or the like may also be formed.

The pressing roller 20 is sufficiently pressed so as to form a nip necessary for heat fixation from opposite end portions with respect to a longitudinal direction by an unshown pressing mechanism provided on the above-described fixing member 10 side. Further, the pressing roller 20 is rotationally driven in a direction of an arrow b (FIG. 3) by an unshown driving device through the core metal 21 from the opposite end portions with respect to the longitudinal direction. As a result, the fixing belt 13 is rotated outside a stay holder 12 in the direction of the arrow a (FIG. 3).

The pressing roller 20 is prepared by forming a 5.0 mm-thick layer of a silicone rubber as the elastic layer 22 on the core metal 21 and by forming a layer of PFA as the parting layer 23 on the elastic layer 22, and is 50 mm in diameter.

The temperature sensor TH2 for acquiring temperature information of the pressing roller 20 is a temperature sensor (temperature detecting element) such as non-contact thermopile, for example, and is provided at a position of a portion opposing a central portion surface of the pressing roller 20 with respect to the longitudinal direction (widthwise direction). In this embodiment, the pressing roller 20 has a constitution in which a heat source is not provided therein, but may also have a constitution in which the heat source is provided therein.

Setting is made so that a feeding speed of the recording material P is 321 mm/sec, a pressure to the pressing roller 20 is 50 kgf, a nip width W of the nip N is 15 mm, and a test environment is a room temperature of 23° C. and a humidity of 50% RH.

(Pressing Roller Cooling Means)

With reference to FIG. 4, fan 31 which is an air cooling type cooling device as the cooling device 30 for the pressing roller 20 will be described. In FIG. 4, a constitution in which four fans 31(*a*), 31(*b*), 31(*c*) and 31(*d*) are provided and arranged in the longitudinal direction of the pressing roller 20. As regards an A4-size sheet, the fans 31(*b*) and 31(*c*) are provided correspondingly to a sheet (paper)-passing region, and the fans 31(*a*) and 31(*d*) are provided correspondingly to a non-sheet (paper)-passing region.

The fan 31 is a device for cooling the pressing roller 20 by blowing air toward the pressing roller 20. As the fan 31, a sirocco fan, a cross-flow fan, an axial-flow fan or the like is used. In this embodiment, the axial-flow fan was used, and the fan rotatable at a number of rotation of 3000 rpm at the maximum was used. The maximum number of rotation of the fan 31 may be larger or smaller than 3000 rpm, and may also be made variable by adjusting a voltage.

The temperature sensor TH2 detects a temperature of the pressing roller 20, and detected temperature information thereof is fed back to the control circuit portion 100. The control circuit portion 100 controls electric power to be inputted to the fan 31 so that a detection temperature to be inputted from this temperature sensor TH2 is maintained at a predetermined time.

(Job Information Processing Portion)

FIG. 5 is a block diagram of a main assembly controller 120 in the image forming apparatus. The main assembly controller 120 includes the control circuit portion (controller) 100, an operating portion 101, an image processing portion 102, an image formation controller 103, an image reading controller 104 and a storing portion 105. Further, the main assembly controller 120 includes, as recording material information acquiring means, a page information acquiring means 107 for acquiring at least a basis weight (only the basis weight or the basis weight and the number of continuous sheets) and a recording paper feeding interval changing portion 108.

The control circuit portion (controller) 100 executes principally a program. The operating portion 101 is electrically connected to the controller 100, and receives input from a user. The operating portion 101 receives not only information on the image to be printed but also instructions such as the print number, setting of both-side/on-side printing and information on a kind of recording paper when the operating portion 101 receives input of a printing job. Here, the information on the kind of the recording paper refers to a size, a basis weight, a material and the like. Incidentally, a constitution in which the information on the size, the basis weight, the material is registered in association with a sheet (paper) feeding stage is employed, and a constitution in which the user is caused to designate the sheet feeding stage of the sheet feeding cassette as the information on the kind of the recording paper may also be employed.

The image processing portion 102 is electrically connected to the control circuit portion 100 and processes image information from the image reading portion 1 or image information on PDL image. The image formation controller 103 is electrically connected to the control circuit portion 100 and controls the image forming portion of the image forming apparatus. The image reading controller 104 is electrically connected to the control circuit portion 100 and controls the image reading portion. The storing portion 105 is electrically connected to the control circuit portion 100 and constitutes a temporarily storing means for processing.

Further, the page information acquiring means 107 acquires setting information on the print number of a job, a so-called "basis weight mixed job" in which printing is carried out while continuously switching the basis weight of the recording paper, and the like, on the basis of information on a printing job inputted by the user. That is, the page information acquiring means 107 acquires information on the basis weight of the recording paper to be used in the printing job, the number of continuous sheets of the recording paper with the basis weight and the order of printing for each of basis weights. The information acquired by the page information acquiring means 107 is transmitted to the control circuit portion 100.

The printing job inputted to the control circuit portion 100 is sent to the storing portion 105, into which the basis weight information or the like of the recording paper on which the image is to be printed has been stored. As a result, the control circuit portion 100 is capable of acquiring input indicating that the recording paper on which the image is formed by the image forming portion 200 and is fixed by the fixing device 6 is changed to recording paper with which basis weight after printing of what number of sheets and that what number of sheets of the recording paper with the same basis weight continues subsequently to the change. Specifically, the control circuit portion 100 is capable of acquiring information such that a page on which the image is currently printed is 300 g/m$^2$ in basis weight, and after 30 pages, the recording paper with a basis weight of 60 g/m$^2$ is fed to the fixing device.

Incidentally, in the First Embodiment, for simplicity, the case where a basis weight mixed job is inputted as a single printing job will be described, but the case as described below also exists. The case where when a printing job A in which printing is carried out only on recording paper with a first basis weight and a printing job B which is different from the printing job B and in which the printing is carried out only on recording paper with a second basis weight are continuously inputted, these two printing jobs are continuously outputted as in a single basis weight mixed job exists.

Also in such a case, the page information acquiring means 107 sends input to the control circuit portion 100 on the basis of information on the printing jobs A and B inputted from the user. The control circuit portion 100 is capable of acquiring information indicating that the recording paper on which the image is formed at the image forming portion 200 and is fixed at the fixing device 6 is changed to recording paper with what basis weight after what number of sheets and that what number of sheets of the recording paper with the same basis weight are continuous subsequently to the change.

Incidentally, the page information acquiring means 107 may also acquire information on a material of the recording paper in addition to the basis weight. The information on the material of the recording paper is information indicating that the recording paper is, for example, plain paper, coated paper, an OHP sheet or a label. Further, as an example of information on respective pages acquired by the page information acquiring means 107, a toner print ratio on the recording paper, a toner printing portion in a recording paper surface and the like are cited.

A copying machine or the like used in on-demand printing has a productivity precedence mode in which productivity is regarded as important, and for example, as regards plain paper and coated paper, a fixing operation is carried out at the same control temperature even in different basis weights. In this embodiment, control is carried out so that a fixing temperature of the fixing belt 13 is 180° C. in terms of a surface temperature.

Further, the recording paper feeding interval changing portion 108 controls an interval (sheet interval) between respective sheets of recording paper on the basis of sheet feeding timing information received from the control circuit portion 100.

(Blister and Cold Offset Occurrence Condition)

FIG. 6 shows a result that in the case where the temperature of the fixing belt 13 is fixed at 180° C., an occurrence condition of a blister and cold offset during sheet passing with a change of a surface temperature condition of the pressing roller 20 was checked. The checked sheets of the recording paper are recording paper with a basis weight of 68 g/m$^2$ (Canon CS680 A4, hereinafter abbreviated as 68 gsm), recording paper with a basis weight of 104 g/m$^2$ (Canon GFC104 A4, hereinafter abbreviated as 104 gsm) and recording paper with a basis weight of 300 g/m$^2$ (Canon GFC300 A4, hereinafter abbreviated as 300 gsm).

The blister and the cold offset were classified by eye-observation ranks in which the case where the blister or the cold offset does not occur is "o", the case where the blister or the cold offset occurs is "x", and the case where the blister slightly occurs is "Δ". As shown in FIG. 6, it turned out that as regards 68 gsm, the blister occurs from the neighborhood of a pressing roller temperature exceeding 100° C., and the cold offset does not occur in a range of 70-120° C.

On the other hand, it turned out that as regards 300 gsm, the cold offset occurs when the pressing roller temperature is 100° C. or less, and the blister does not occur in a range of 70-120° C. As regards, 104 gsm which is intermediate between both the cases (68 gsm and 300 gsm), it turned out that the blister occurs when the pressing roller temperature is 120° C. or more, and the cold offset occurs when the pressing roller temperature is 80° C. or less.

A target temperature of the pressing roller for each of the sheets of recording paper when the fixing belt temperature is 180° C. is shown in FIG. 7. TU represents an upper-limit temperature (upper-limit target temperature) of a target temperature range, and TL is a lower-limit temperature (lower-limit target temperature) of the target temperature range, and these temperatures are determined depending on the basis weight of the recording material (recording paper). Further, by carrying out control so that a pressing roller temperature Tp satisfies TL<Tp, the blister and the cold offset can be compatibly prevented (suppressed).

(Control During Use of Sheets of Recording Paper in Mixture)

In the following, temperature control of the pressing roller in a mixed job in which sheets of recording paper s with different basis weights are successively fed (used) will be described. In the fixing device 6 in this embodiment, in the case where the recording paper to be used in a fixing process (image heating process) is changed from recording paper with a small basis weight to recording paper with a large basis weight, the pressing roller temperature is set at a pressing roller temperature suitable for the recording paper with the large basis weight at the time of a start of the fixing process of the recording paper with the large basis weight. Then, the pressing roller temperature is started to be increased without waiting an end of the fixing process of the recording paper with the small basis weight, so that this temperature control is achieved.

Here, a job in which the recording paper with the small basis weight is subjected to the fixing process in advance is referred to as a preceding job, and a job in which the recording paper with the large basis weight is subjected to the fixing process subsequently to the preceding job is referred to as a subsequent job. These jobs may be a part of a single basis weight mixed job and may also be considered as a first job and a second job in the case where separate jobs are continuously inputted in a short time.

Here, a job in which continuous printing of images on the sheets of recording paper of 104 gsm is switched to continuous printing of images on the sheets of recording paper of 300 gsm during the job will be described as an example.

Figure 8:
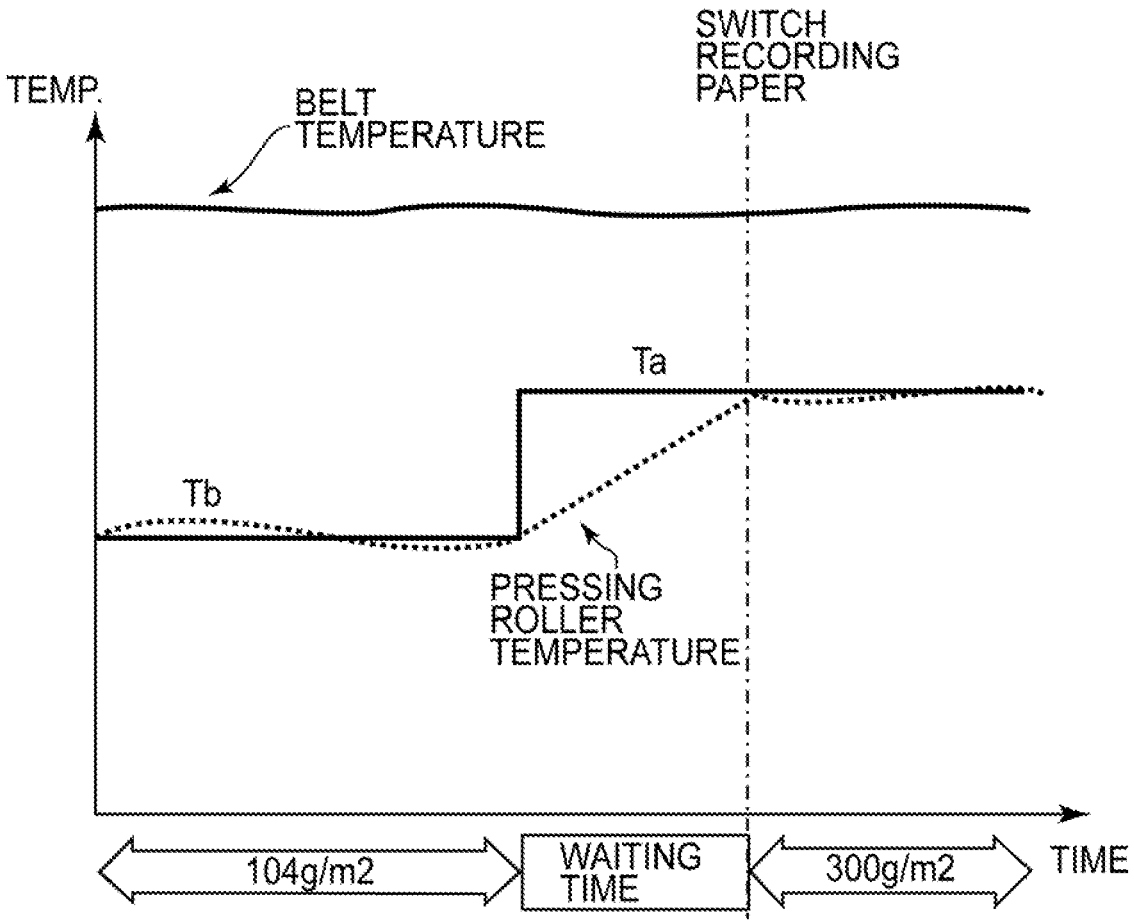
FIG. 8 is a graph of a temperature change when a basis weight is switched from 104 gsm to 300 gsm in a conventional example as a comparison example.

In FIG. 8, a temperature change in a conventional example as a comparison example is shown. The fixing belt is controlled in a state in which the target temperature is fixed at 180° C. Tb is a target temperature of the pressing roller during sheet passing of the recording paper with the basis weight of 104 gsm, which is preceding paper, and Ta is a target temperature of the pressing roller during sheet passing of the recording paper with the basis weight of 300 gsm, which is subsequent paper. In this embodiment, Tb is 100° C. and Ta is 120° C.

In FIG. 8, as regards the pressing roller temperature, a dotted line represents a time change of an actual temperature in the pressing roller, and a solid line represents a time change of the target temperature in the pressing roller.

In such a conventional example, when the recording paper of 300 gsm which is the subsequent paper is passed through the fixing device without providing a waiting time at the time of switching the recording paper, there is a possibility that the pressing roller temperature is low and the cold offset occurs. Therefore, during a temperature rise up to Ta suitable for the pressing roller temperature of the recording paper of 300 gsm, there is a need to provide the waiting time. In this case, a degree of a lowering in productivity during use of the sheets of recording paper in mixture becomes large.

Figure 9:
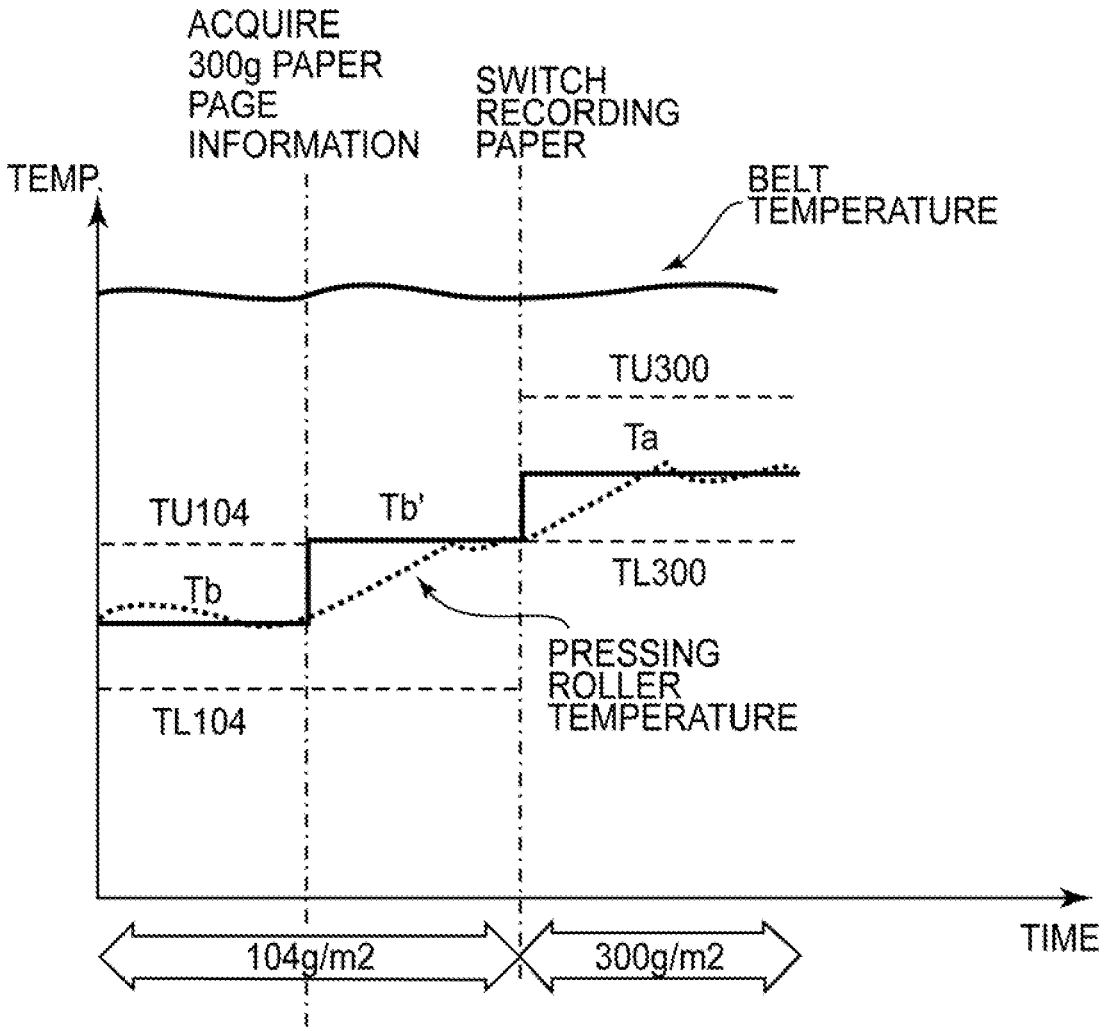
FIG. 9 is a graph of a temperature change when the basis weight is switched from 104 gsm to 300 gsm.

On the other hand, a temperature change of the pressing roller in the First Embodiment is shown in FIG. 9. In FIG. 9, as regards the pressing roller temperature, a dotted line represents a time change of an actual temperature in the pressing roller, and a solid line represents a time change of a target temperature in the pressing roller.

In the First Embodiment, an upper limit temperature TU and a lower limit temperature TL as a target temperature range of the pressing roller 20 are provided for each of basis weights of the sheets of recording paper, and the target temperature is changed in the target temperature range from the upper limit temperature TU to the lower limit temperature LT. In FIG. 9, when the recording paper of 104 gsm which is the preceding paper is passed through the fixing device, an upper limit temperature TU104 and a lower limit temperature TL104 of the pressing roller 20 are set. TU104 is 110° C., and TL104 is 90° C. In the case of the recording paper of 104 gsm which is the preceding paper, a target temperature Tb of the pressing roller is set at 100° C. even when use of the sheets of recording paper in mixture is made or is not made.

Here, in the case where information on the recording paper of 300 gsm is acquired in advance as page information of the subsequent paper during sheet passing of the recording paper of 104 gsm, the target temperature of the pressing roller 20 is changed as shown in FIG. 9. Specifically, TU104 and TL104 are compared with a pressing roller target temperature Ta for the recording paper of 300 gsm, so that the target temperature is set at TU104 (Tb') which is a temperature closer to Ta.

Here, a change from Tb to Tb' is carried out at or after the time of acquiring page information on the subsequent paper for which the basis weight is switched, without waiting an end of the fixing process of the preceding paper before the switching of the basis weight. Specifically, the temperature of the pressing roller is increased by weakening an output of the cooling for 31 of the cooling device 30 or by turning off the cooling fan 31. On the other hand, the temperature of the pressing roller is decreased by strengthening the output of the cooling fan 31.

Here, Tb' is a target temperature of the pressing roller when a leading end of a first page of the recording paper which is the subsequent paper for which the basis weight is switched reaches the nip N, and is a temperature such that the cold offset does not occur in the subsequent paper. That is, the control circuit portion 100 starts to increase the pressing roller temperature so that the pressing roller temperature at the time of a start of the subsequent job is Tb', without waiting an end of the fixing process of the image on the preceding paper before the switching of the basis weight. In the First Embodiment, the control circuit portion 100 starts exposure of the image to be formed on the first page of the subsequent paper depending on that the target temperature of the pressing roller reaches Tb'.

Accordingly, in this embodiment, the time of a start of the exposure of the image to be formed on the first page of the subsequent paper is the time of a start of the subsequent job, but the time when the leading end of the first page of the subsequent paper (recording paper) reaches the nip N may also be the toner of the start of the subsequent job.

Incidentally, in this embodiment, the case where the pressing roller is not provided with a heating source is described as an example, but in the case where the pressing roller is provided with the heating source, an output of the heating source may also be increased.

Further, in this embodiment the target temperature is changed from Tb to Tb' at the time when the page information on the subsequent paper for which the basis weight is switched is acquired is described, but the following constitution may also be employed. That is, in the case where information indicating that the recording paper of 300 gsm comes as a 31-th sheet after the images are printed on 30 sheets of the recording paper of 104 gsm is acquired, the target temperature may also be switched after waiting until the time of a lapse of a predetermined number of sheets from the final recording paper of 104 gsm (i.e., after the images are printed on, for example, 10 sheets). Further, the number of waiting sheets may also be determined on the basis of an output of a detecting portion for detecting the pressing roller temperature at the time when the page information on the subsequent paper for which the basis weight is switched is acquired. Incidentally, this is controlled within a range in which a defect such as the blister does not occur on the recording paper with a small basis weight before the basis weight is switched.

As a result, compared with the case where the target temperature change of the pressing roller is carried out after waiting the end of the fixing process of the image on the preceding paper before the switching of the basis weight, the pressing roller temperature can be immediately changed to a pressing roller temperature means for the subsequent paper during switching of the recording paper.

Thereafter, when the recording paper of 300 gsm is passed through the fixing device (nip N), the pressing roller target temperature is changed to Ta. Ta is 120° C.

Figure 10:
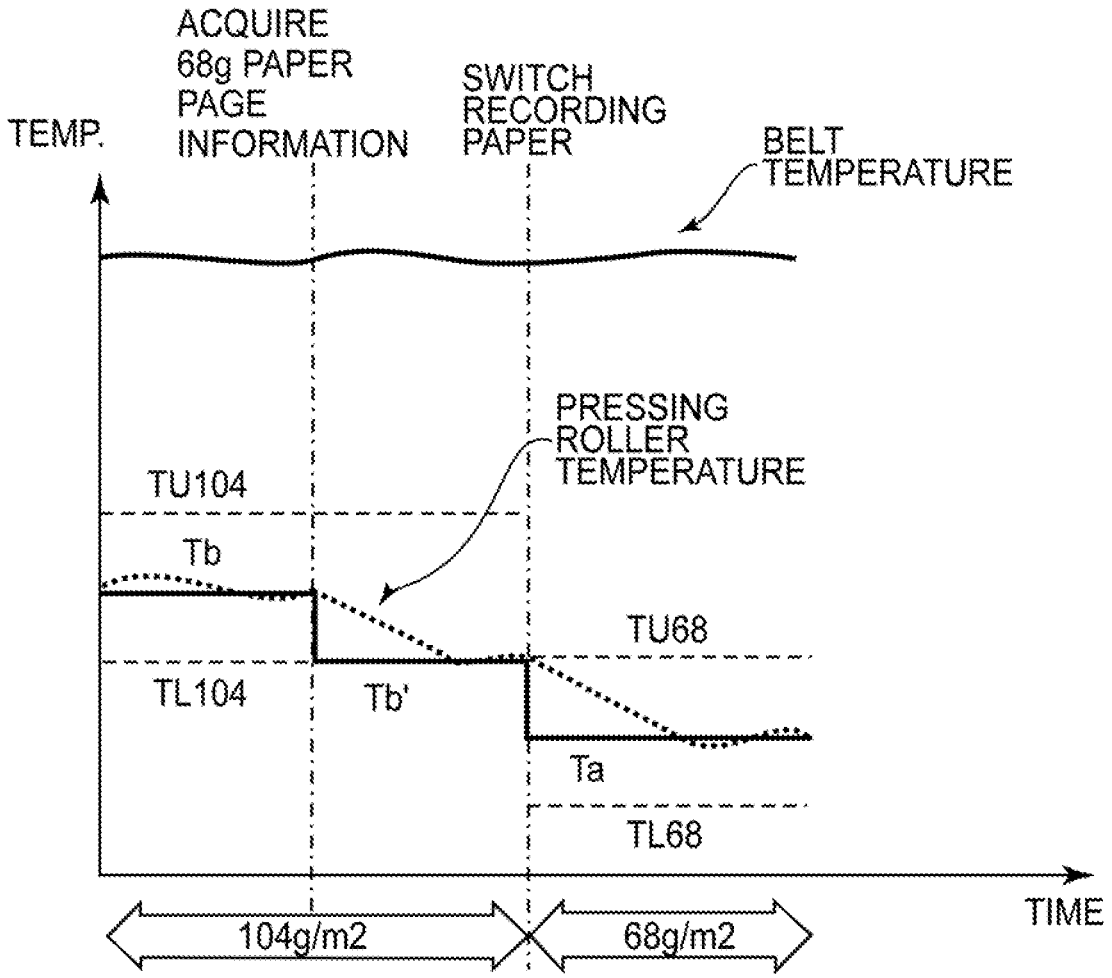
FIG. 10 is a graph of a temperature change when the basis weight is switched from 104 gsm to 68 gsm.

In the above, switching from the recording paper small in basis weight to the recording paper large in basis weight was described, but an effect of improving productivity is achieved also in the case of switching from the recording paper large in basis weight to the recording paper small in basis weight. In FIG. 10, a temperature change when continuous printing of images on the sheets of recording paper of 104 gsm to continuous printing of images on the sheets of recording paper of 68 gsm during the job is shown. When the recording paper of 104 gsm which is the preceding paper is passed through the fixing device, the upper limit temperature TU104 and the lower limit temperature TL104 which constitute the target temperature range of the pressing roller are set. TU104 is 110° C., and TL104 is 90° C. In the case of the recording paper of 104 gsm which is the preceding paper, the pressing roller target temperature Tb is set at 100° C.

Here, in the case where during the sheet passing of the recording paper of 104 gsm, information on the recording paper of 68 gsm is acquired in advance as the page information on the subsequent paper, the pressing roller target temperature is changed as shown in FIG. 10. Specifically, TU104 and TL104 are compared with the pressing roller target temperature Ta for the recording paper of 68 gsm, and the target temperature is set at TL104 (Tb') closer to Ta.

Here, the change from Tb to Tb' is carried out, before the time of switching of the recording paper, at the time when the page information on the subsequent paper is acquired in advance. As a result, compared with the case where the change of the pressing roller target temperature is carried out at the time of switching of the recording paper, the pressing roller temperature can be immediately changed to a pressing roller temperature necessary for the switching of the recording paper. Thereafter, when the recording paper of 68 gsm is passed through the fixing device, the pressing roller target temperature is changed to Ta. Ta is 80° C.

(Control Flow)

Figure 11:
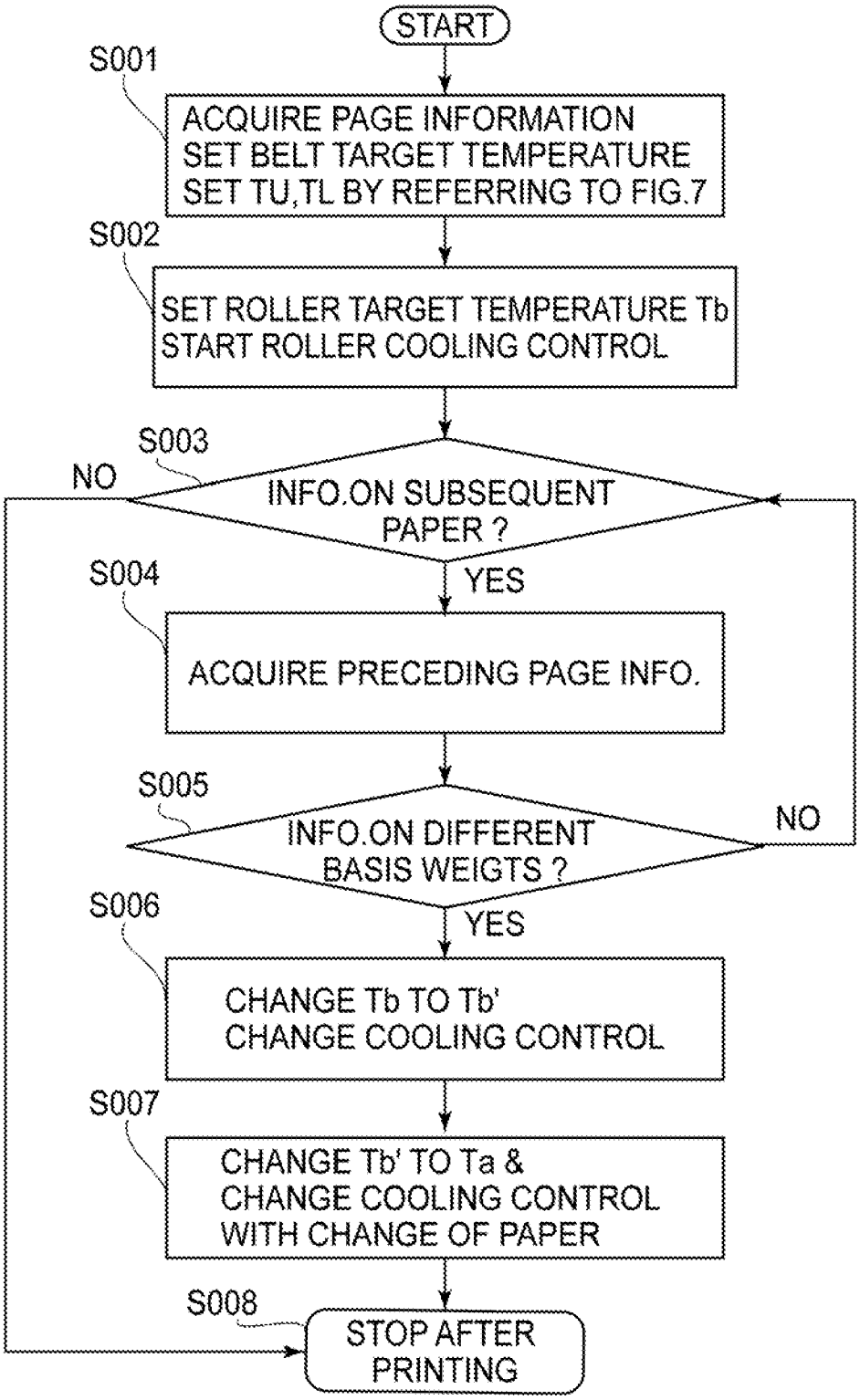
FIG. 11 is a flowchart in the First Embodiment.

In FIG. 11, a control flowchart of the First Embodiment is shown.

(S001)

When the main assembly controller 120 (FIG. 5) receives a printing job signal, the page information acquiring means 107 (FIG. 5) acquires page information on the recording paper, and the control circuit portion (FIG. 5) sets the upper limit temperature TU and the lower limit temperature TL of the target temperature range of the pressing roller.

(S002)

The control circuit portion 100 (FIG. 5) sets the target temperature Tb by making reference to the upper limit temperature TU and the lower limit temperature TL, and starts cooling control of the pressing roller.

(S003)

In the case where page information on the subsequent paper exists, the sequence goes to S004. In the case where the page information on the subsequent paper does not exist, the sequence goes to S008.

(S004)

During printing, the page information acquiring means 107 (FIG. 5) acquires the page information on the subsequent recording paper.

(S005)

In the case where the preceding page information includes information on a basis weight of the recording paper different from a basis weight of the recording paper used during current printing, the sequence goes to S006. In the case where the preceding page information includes the information on the different basis weight of the recording paper, the sequence goes to S003.

(S006)

The control circuit portion 100 (FIG. 5) changes the pressing roller target temperature to Tb' and thus change pressing roller cooling control. In this embodiment, the pressing roller target temperature is changed to Tb', whereby the pressing roller temperature reaches a lower limit temperature suitable for the basis weight of the subsequent paper during the fixing process of the preceding paper or during a sheet interval immediately after the fixing process of the preceding paper without increasing a sheet interval between the preceding paper and the subsequent paper. Accordingly, passing of the subsequent paper can be continuously started.

(S007)

In synchronism with timing of switching of the kind of the recording paper passing through the fixing device, the control circuit portion 100 (FIG. 5) changes the pressing roller target temperature to Ta, and thus changes the pressing roller cooling control.

(S008)

The control is ended after the images are printed on all the sheets of recording paper (recording materials).

In the above, the First Embodiment in which as the target temperature range of the pressing roller, the upper limit temperature and the lower limit temperature are set and in which the information on the subsequent paper is acquired in advance in the case where different sheets of recording paper are used in mixture and then the pressing roller target temperature is changed before the recording paper is switched was described. As a result, it is possible to compatibly realize an improvement of productivity and suppression (prevention) of image defects when the different sheets of the recording paper are used in mixture.

Second Embodiment

In the following, as an embodiment of the present invention, Second Embodiment different the above-described First Embodiment will be described. Incidentally, constituent elements similar to those of the above-described embodiment will be omitted from description by adding thereto the same reference numerals or symbols.

As described in the First Embodiment, it is preferable that before the recording paper with the different basis weight is fed in the job as the subsequent job, the recording paper information (basis weight) in the subsequent job is acquired in advance and then the target temperature of the pressing roller is changed in advance in a range in which there is no influence on the fixed image. Further, in the case where a difference in basis weight between the sheets of recording paper used in mixture is large and the control is not in time for the suppression of the image defection by the temperature change in advance, it is preferable that the productivity is not lowered to the extent possible by shortening a time, in which the feeding of the subsequent recording paper is temporarily stopped to the extent possible.

That is, in the First Embodiment, the case where the waiting time does not generate during the switching of the basis weight was described as an example, but in this Second Embodiment, the case where the difference in basis weight between the sheets of recording paper used in mixture is large and it is difficult to switch the recording paper by continuously changing the target temperature of the pressing roller will be described. Incidentally, also in this embodiment, in the case where the basis weight difference is small and where possible, it is preferable that the recording paper is switched with no waiting time as in the First Embodiment.

In the Second Embodiment, the recording paper feeding interval changing portion 108 (FIG. 5) predicts a waiting time necessary for switching of the recording paper at the time when the preceding page information is acquired. That is, in FIG. 12, a temperature change when the printing is switched from continuous printing of the images on the sheets of recording paper of 68 gsm to continuous printing of the images on the sheets of recording paper of 300 gsm during the job is shown. When the recording paper of 68 gsm which is the preceding paper is passed through the fixing device, an upper limit temperature TU68 and a lower limit temperature TL68 in the target temperature range of the pressing roller 20 are set. TU68 is 90° C., and TL68 is 70° C. In the case of the recording paper of 68 gsm, a target temperature Tb of the pressing roller is set at 80° C. even when use of the sheets of recording paper in mixture is made or is not made.

Here, in the case where information on the recording paper of 300 gsm is acquired in advance as page information of the subsequent paper during sheet passing of the recording paper of 68 gsm, the target temperature of the pressing roller 20 is changed from Tb to Tb'. Specifically, TU68 and TL68 are compared with a pressing roller target temperature Ta for the recording paper of 300 gsm, so that as the pressing roller target temperature Tb', the target temperature is set at TU68 which is a temperature closer to Ta.

Here, the change from Tb to Tb' as the pressing roller target temperature is carried out at the time of acquiring page information on the subsequent paper job, before the time of switching of the recording paper.

As a result, compared with the case where the target temperature change of the pressing roller is carried out at the time of the switching of the recording paper, the pressing roller temperature can be immediately changed to a pressing roller temperature means for the time of the switching of the recording paper.

Here, the pressing roller target temperature at the time of an end of printing of the images on the recording paper of 68 gsm is 90° C. (Tb'). Then, in the case where the subsequent paper of 300 gsm is passed through the fixing device, when the target temperature does not exceed at least the lower limit temperature TL300 (110° C.) of the pressing roller target temperature, there is a possibility that the cold offset occurs during the continuous printing of the images on the sheets of recording paper of 300 gsm. Therefore, in a period in which the pressing roller temperature is increased from 90° C. (Tb') to 110° C. (TL300), the feeding of the sheets of recording paper of 300 gsm is temporarily stopped and a waiting time is provided.

Figures 12, 13:
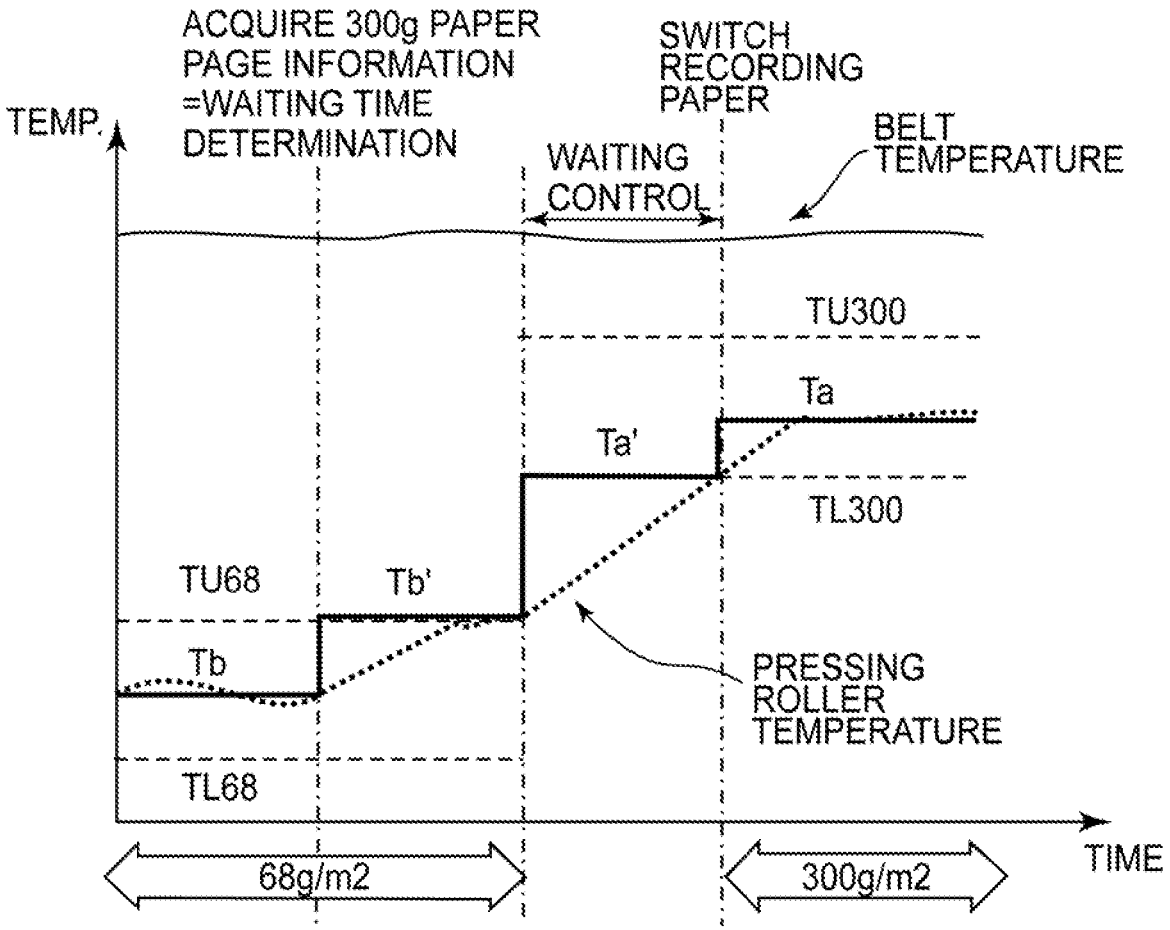
FIG. 12 is a graph of a temperature change when the basis weight is switched from 68 gsm to 300 gsm.
FIG. 13 is a relation table between a pressing roller target temperature different and a waiting time.

At this time, the target temperature difference (90° C.-110° C.) and the temperature rise of the pressing roller can be determined at the time when the page information in the subsequent job is acquired in advance. In FIG. 13, a relationship of waiting time between the pressing roller target temperature (Tb') before the switching of the recording paper and the pressing roller target temperature (TU300 or TL300) after the switching of the recording paper is shown. In the case where the pressing roller target temperature (Tb') before the switching is 90° C. and the upper limit temperature TU300 or the lower limit temperature TL300 as the pressing roller target temperature range after the switching is 110° C., the waiting time is 10 sec.

Thus, in the Second Embodiment, as a shortened waiting time, it is possible to grasp an necessary waiting time in advance, so that it is possible to realize suppression of the lowering in productivity.

The pressing roller target temperature (Tb') in this waiting time is set by comparing the upper limit temperature TU300 and the lower limit temperature TL300 as the pressing roller target temperature range set during the passing of the sheets of recording paper of 300 gsm, with the pressing roller target temperature Ta. Specifically, the pressing roller target temperature is set at TL300 close to Ta.

Thereafter, when the recording paper of 300 gsm is passed through the fixing device (nip N), the pressing roller target temperature is changed to Ta. Ta is 120° C.

In the above, as the Second Embodiment, switching from the recording paper small in basis weight to the recording paper large in basis weight was described, but an effect of improving productivity is achieved also in the case of switching from the recording paper large in basis weight to the recording paper small in basis weight, as the Second Embodiment and this will be described below.

Figure 14:
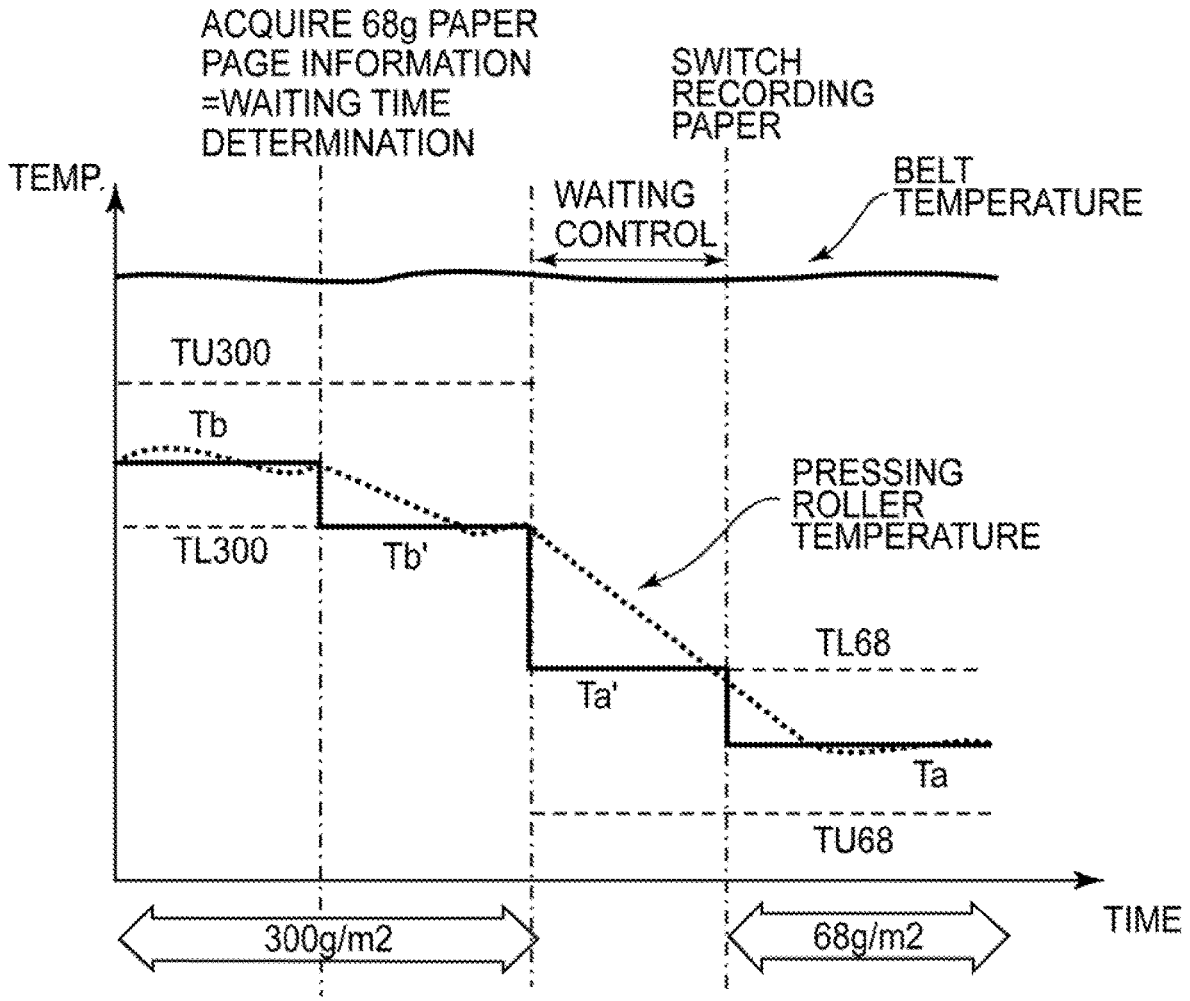
FIG. 14 is a graph of a temperature change when the basis weight is switched from 300 gsm to 68 gsm.

In FIG. 14, a temperature change when continuous printing of images on the sheets of recording paper of 300 gsm to continuous printing of images on the sheets of recording paper of 68 gsm during the job is shown. When the recording paper of 300 gsm is passed through the fixing device, the upper limit temperature TU300 and the lower limit temperature TL300 as the target temperature range of the pressing roller are set. TU300 is 130° C., and TL300 is 110° C. In the case of the recording paper of 300 gsm which is the preceding paper, the pressing roller target temperature Tb is set at 120° C. even when use of the sheets of recording paper in mixture is made or is not made.

Here, in the case where during the sheet passing of the recording paper of 300 gsm, information on the recording paper of 68 gsm is acquired, in advance as the page information on the subsequent paper, the pressing roller target temperature is changed as from Tb to Tb'. Specifically, TU300 and TL300 are compared with the pressing roller target temperature Ta for the recording paper of 68 gsm, and the target temperature is set at TL300 (Tb') closer to Ta.

The change from Tb to Tb' as the pressing roller target temperature is carried out, before the time of switching of the recording paper, at the time when the page information is acquired. As a result, compared with the case where the change of the pressing roller target temperature is carried out at the time of switching of the recording paper, the pressing roller temperature can be immediately changed to a pressing roller temperature necessary for the switching of the recording paper.

Here, the pressing roller target temperature at the time of an end of the printing of the images on the sheets of recording paper of 300 gsm is 110° C. (Tb'), but when the subsequent sheets of paper of 68 gsm are passed through the fixing device, there is a need that the pressing roller target temperature exceeds at least the upper limit temperature TU68 (90° C.) of the target temperature range of the sheets of recording paper of 68 gsm. That is, in the case where the target temperature does not exceed the upper limit temperature TU68 (90° C.), there is a possibility that the blister generates during the continuous printing the sheets of recording paper of 68 gsm.

Therefore, in a period in which the pressing roller temperature lowers from 110° C. (Tb') to 90° C. (TU68), the feeding of the sheets of recording paper of 300 gsm is temporarily stopped and a waiting time is provided. Here, a pressing roller target temperature difference (110° C.-90° C.) and a time necessary to lower the temperature ca be determined at the time when the preceding page information is acquired.

In FIG. 13, a relationship of the waiting time between the pressing roller target temperature (Tb') before the recording paper switching and the pressing roller target temperature (TU68 or TL68) after the recording paper switching is shown. In the case where the pressing roller target temperature (Tb') before the recording paper switching is 110° C. and the upper limit temperature TU68 or the lower lint temperature TL68 as the pressing roller target temperature range after the recording paper switching is 90° C., the waiting time is 10 sec. Thereafter, when the recording paper of 68 gsm is passed through the fixing device, the pressing roller target temperature is changed to Ta. Ta is 80° C.

As described above, in the Second Embodiment, the necessary waiting time can be grasped in advance, so that suppression of a lowering in productivity can be realized.

(Control Flow)

Figure 15:
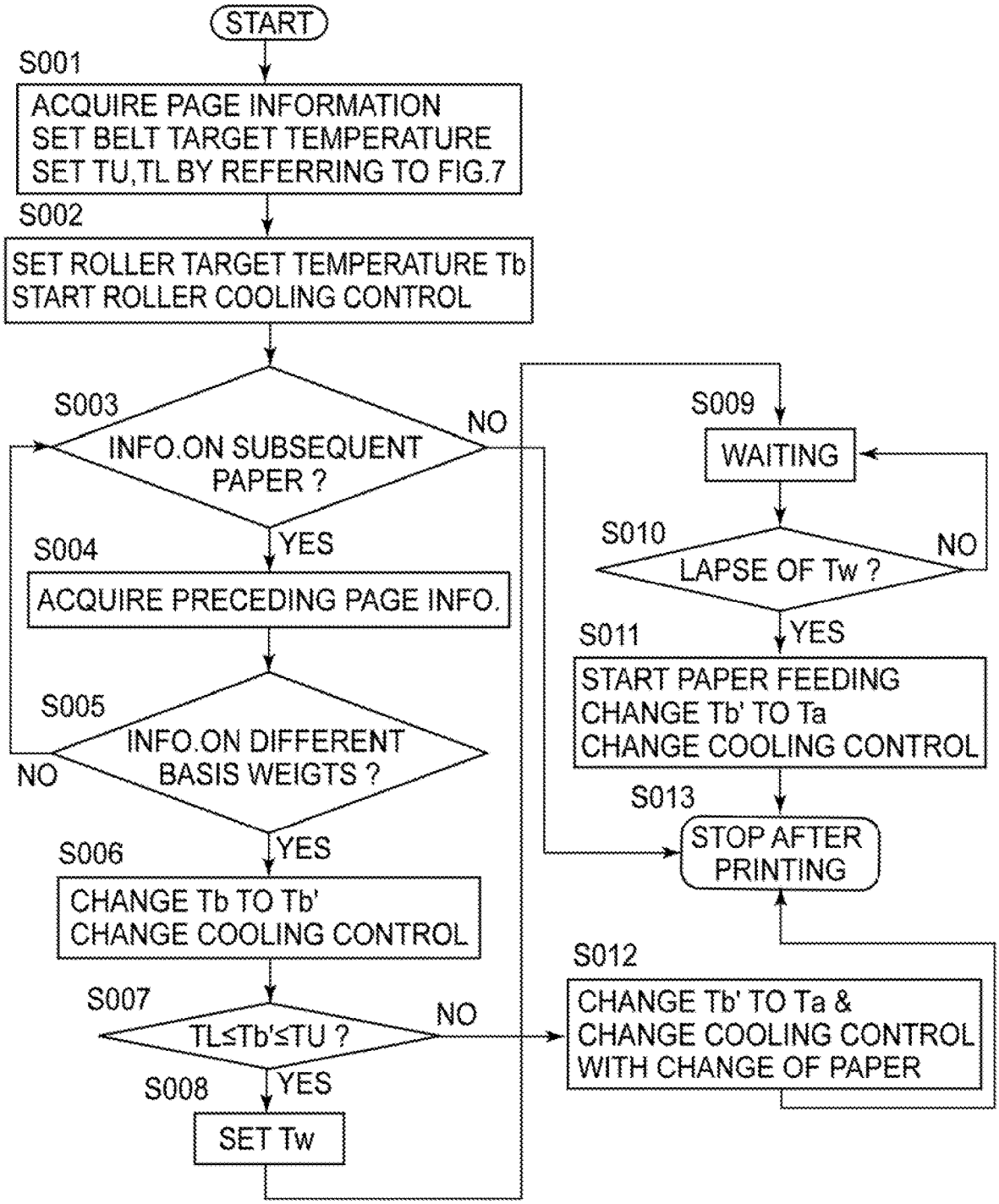
FIG. 15 is a flowchart in Second Embodiment.

In FIG. 15, a control flowchart of the Second Embodiment is shown.

(S001)

When the main assembly controller 120 (FIG. 5) receives a printing job signal, the page information acquiring means 107 (FIG. 5) acquires page information on the recording paper, and the control circuit portion (FIG. 5) sets the upper limit temperature TU and the lower limit temperature TL of the target temperature range of the pressing roller.

(S002)

The control circuit portion 100 (FIG. 5) sets the target temperature Tb by making reference to the upper limit temperature TU and the lower limit temperature TL, and starts cooling control of the pressing roller.

(S003)

In the case where page information on the subsequent paper exists, the sequence goes to S004. In the case where the page information on the subsequent paper does not exist, the sequence goes to S013.

(S004)

During printing, the page information acquiring means 107 (FIG. 5) acquires the page information on the subsequent recording paper.

(S005)

In the case where the preceding page information includes information on a basis weight of the recording paper different from a basis weight of the recording paper used during current printing, the sequence goes to S006. In the case where the preceding page information includes the information on the different basis weight of the recording paper, the sequence goes to S003.

(S006)

The control circuit portion 100 (FIG. 5) changes the pressing roller target temperature to Tb' and thus change pressing roller cooling control.

(S007)

In the case where Tb' is included between the upper limit temperature TU and the lower limit temperature TL of the pressing roller target temperature range for the subsequent paper, the sequence goes to S008, and in the case where Tb' is not included between the upper limit temperature TU and the lower limit temperature TL, the sequence goes to S012.

(S008)

The recording paper feeding interval changing portion 108 (FIG. 5) determines a waiting time (Tw) during the recording paper switching by making reference to FIG. 13.

(S009)

The predetermined feeding interval changing portion 108 (FIG. 5) starts waiting in the waiting time (Tw) at the time of an end of printing of the images on the preceding recording paper.

(S010)

When the waiting time Tw elapses, the sequence goes to S011.

(S011)

Feeding of the subsequent paper is started, and the control circuit portion 100 (FIG. 5) changes the pressing roller target temperature to Ta and thus changes the pressing roller cooling control, so that the sequence goes to S013.

(S012)

The cooling control is premised on the case where Tb' is not included between the upper limit temperature TU and the lower limit temperature TL of the pressing roller target temperature range for the subsequent sheets of paper.

In this case, in synchronism with timing of switching of the kind of the recording paper passing through the fixing device, the control circuit portion 100 (FIG. 5) changes the pressing roller target temperature to Ta, and thus changes the pressing roller cooling control.

(S013)

The control is ended after the images are printed on all the sheets of recording paper (recording materials).

In the above, the Second Embodiment in which as the target temperature of the pressing roller, the upper or lower limits is set, in which the information on the subsequent paper is acquired in advance in the case where different sheets of recording paper are used in mixture and then the pressing roller target temperature is changed before the recording paper is switched and in which the waiting time during the recording paper switching is determined was described.

In the Second Embodiment, on the basis of at least the basis weight as the recording material information in the subsequent job in which the kind of the recording material is switched, before the kind of the recording material is switched, the pressing roller target temperature is made high in the case where the basis weight increase in the subsequent job. In addition, the pressing roller target temperature is made low in the case where the basis weight decreases in the subsequent job.

Then, the controller further carries out the following control when the pressing roller target temperature before the switching of the kind of the recording material is a first target temperature and the pressing roller target temperature changed from the first target temperature before the switching of the kind of the recording material is a second target temperature. That is, on the basis of the first target temperature and the second target temperature, the controller controls a feeding interval of the recording materials in the subsequent job (i.e., controls the waiting time in the subsequent job). As a result, in this embodiment, the waiting time during the recording paper switching is shortened, and it is possible to compatibly realize an improvement of productivity and suppression (prevention) of image defects when the different sheets of the recording paper are used in mixture.

Third Embodiment

In the following, Third Embodiment will be described. Incidentally, constituent elements similar to those of the above-described embodiment will be omitted from description by adding thereto the same reference numerals or symbols.

As described in the First Embodiment, it is preferable that before the recording paper with the different basis weight is fed in the job as the subsequent job, the recording paper information in the subsequent job is acquired in advance and then the target temperature of the pressing roller is changed in advance in a range in which there is no influence on the fixed image. Further, in the case where a difference in basis weight between the sheets of recording paper used in mixture is large and the control is not in time for the suppression of the image defection by the temperature change in advance, it is preferable that the productivity is not lowered to the extent possible by shortening a time, in which the feeding of the subsequent recording paper is temporarily stopped to the extent possible. Further, it is preferable that the target temperature is changed to a necessary and sufficient pressing roller target temperature depending on the continuous print number of sheets of the subsequent recording paper and thus productivity is not lowered to the extent possible.

That is, in this embodiment, the pressing roller target temperature is determined depending on the continuous print number of sheets of the recording paper.

Figure 16A:
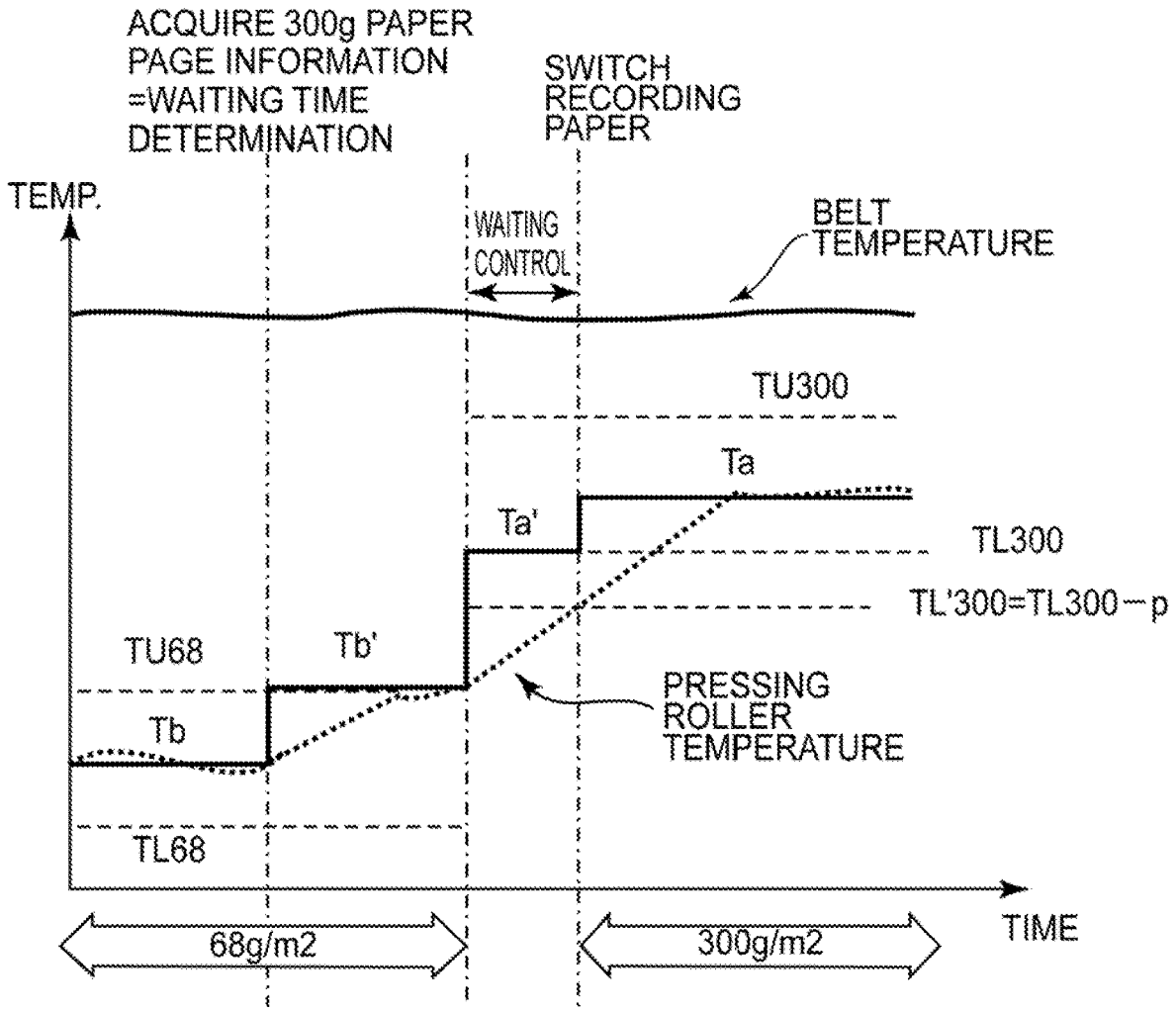
FIG. 16A is a graph of a temperature change when the basis weight is switched from 68 gsm to 300 gsm in Third Embodiment.

In this embodiment, the recording paper feeding interval changing portion 108 (FIG. 5) predicts a waiting time necessary for switching of the recording paper at the time when the preceding page information is acquired. That is, in FIG. 16, a temperature change when the printing is switched from continuous printing of the images on the sheets of recording paper of 68 gsm to continuous printing of the images on the sheets of recording paper of 300 gsm during the job is shown. When the recording paper of 68 gsm which is the preceding paper is passed through the fixing device, an upper limit temperature TU68 and a lower limit temperature TL68 in the target temperature range of the pressing roller 20 are set. TU68 is 90° C., and TL68 is 70° C. In the case of the recording paper of 68 gsm, a target temperature Tb of the pressing roller is set at 80° C.

Here, in the case where information on the recording paper of 300 gsm is acquired in advance as page information of the subsequent paper during sheet passing of the recording paper of 68 gsm, the target temperature of the pressing roller 20 is changed from Tb to Tb'. Specifically, TU68 and TL68 are compared with a pressing roller target temperature Ta for the recording paper of 300 gsm, so that as the pressing roller target temperature Tb', the target temperature is set at TU68 which is a temperature closer to Ta.

Here, the change from Tb to Tb' as the pressing roller target temperature is carried out at the time of acquiring page information on the subsequent paper job, before the time of switching of the recording paper.

As a result, compared with the case where the target temperature change of the pressing roller is carried out at the time of the switching of the recording paper, the pressing roller temperature can be immediately changed to a pressing roller temperature means for the time of the switching of the recording paper.

Here, the lower limit temperature of the pressing roller target temperature changes depending on the continuous print number of sheets of the subsequent paper when the sheets of the subsequent paper of 300 gsm are passed through the fixing device. That is, a necessary heat quantity is large when the continuous print number of sheets is large, but the necessary heat quantity is small when the continuous print number of sheets is small, and therefore, it is possible to set the lower limit temperature at a low value.

Figure 16B:
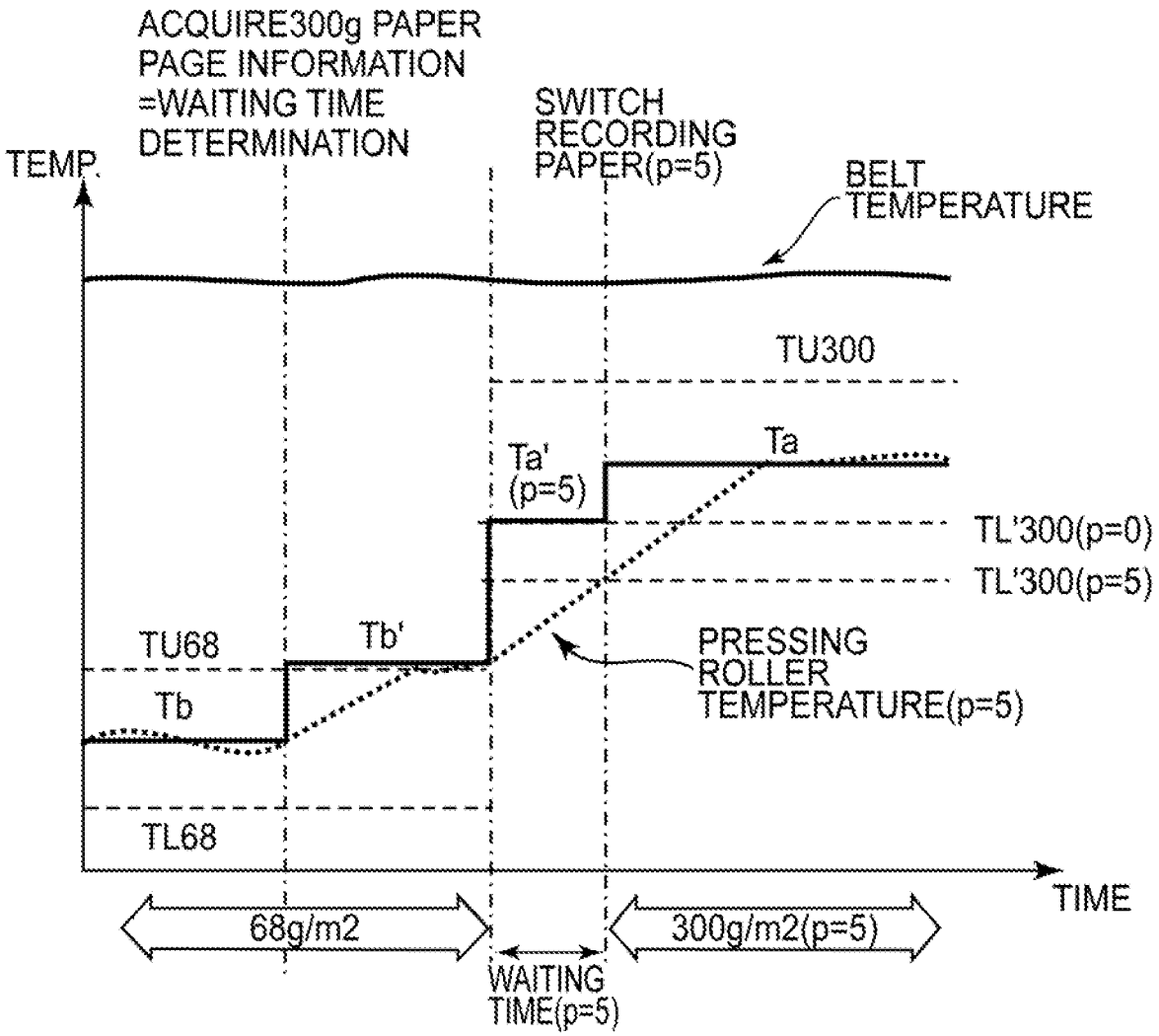
FIG. 16B is a graph of a temperature change in the case of 10 sheets of 300 gsm in basis weight.
Figures 16C, 17:
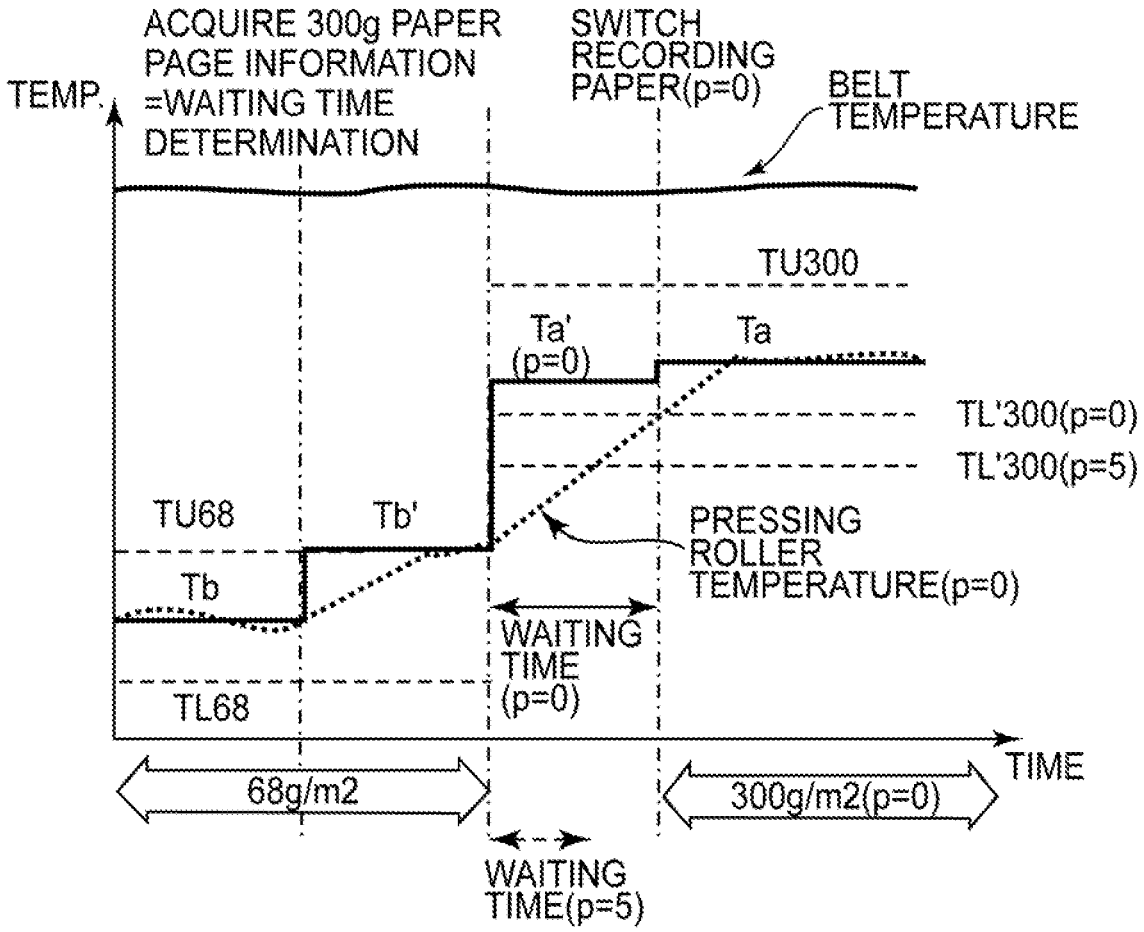
FIG. 16C is a graph of a temperature change in the case of 20 sheets of 300 gsm in basis weight.
FIG. 17 is a table showing a basis weight of a subsequent recording material and a correction temperature depending on a number of sheets of subsequent recording materials.

Here, the lower limit temperature of the pressing roller determined from information on the number of sheets of the subsequent paper is (corrected lower limit temperature TL') =(reference lower limit temperature TL)−(corrected temperature p). In this embodiment, description will be made by taking the reference lower limit temperature TL as the lower limit temperature of the pressing roller target temperature in the case where sheets of the recording paper of 300 gsm in a large amount (20 sheets or more in an example of FIG. 17) and by setting the reference lower limit temperature at TL300 (110° C.). Incidentally, FIG. 16C is a graph showing a change in target temperature of the pressing roller at this time. Further, FIG. 16B is a graph showing a change in target temperature of the pressing roller in the case where at the lower limit temperature TL, several sheets (6 to 10 sheets in the example of FIG. 17) of the recording paper of 300 gsm are passed through the fixing device.

In FIG. 17, a relationship of the corrected temperature p with respect to the continuous print number of sheets of the subsequent paper. Here, in the case where the continuous print number of sheets of the subsequent paper of 300 gsm is not 20 sheets or more, but is for example 3 sheets, the corrected lower limit temperature TL'300 is TL'300=100° C. from a relationship between the lower limit temperature TL (110° C.) and the corrected temperature p (10° C.).

Here, the pressing roller target temperature at the time of an end of printing of the images on the recording paper of 68 gsm is 90° C. (Tb'). Then, in the case where the subsequent paper of 300 gsm is passed through the fixing device, when the target temperature does not exceed at least the corrected lower limit temperature TL'300 (100° C.) of the pressing roller target temperature, there is a possibility that the cold offset occurs during the continuous printing of the images on the sheets of recording paper of 300 gsm. Therefore, in a period in which the pressing roller temperature is increased from 90° C. (Tb') to 100° C. (TL'300), the feeding of the sheets of recording paper of 300 gsm is temporarily stopped and a waiting time is provided. At this time, the pressing roller target temperature is Ta'.

At this time, the target temperature difference (90° C.-110° C.) and the temperature rise of the pressing roller can be determined at the time when the page information in the subsequent job is acquired in advance. From the relationship FIG. 13, in the case where the pressing roller target temperature (Tb') before the switching is 90° C. and the pressing roller target temperature after the switching is 100° C., the waiting time is 5 sec.

Thus, in this embodiment, on the basis of information on the continuous print number of sheets of the subsequent paper, it is possible to shorten an necessary waiting time in advance, so that it is possible to realize suppression of the lowering in productivity.

Incidentally, in FIG. 16B and FIG. 16C, description is made using an example in which the pressing roller target temperature Ta' is changed depending on the number of sheets of the subsequent paper without changing the pressing roller target temperature Tb' during the fixing of the images on the sheets of the recording paper of 68 gsm. However, when the target temperature can be controlled in a range of TL68 or more and TU68 or less, the pressing roller target temperature Tb' in the case where the continuous print number of sheets of the subsequent paper is large may also be made higher than that in the case where the continuous print number of sheets of the subsequent paper is small.

(Control Flow)

Figure 18:
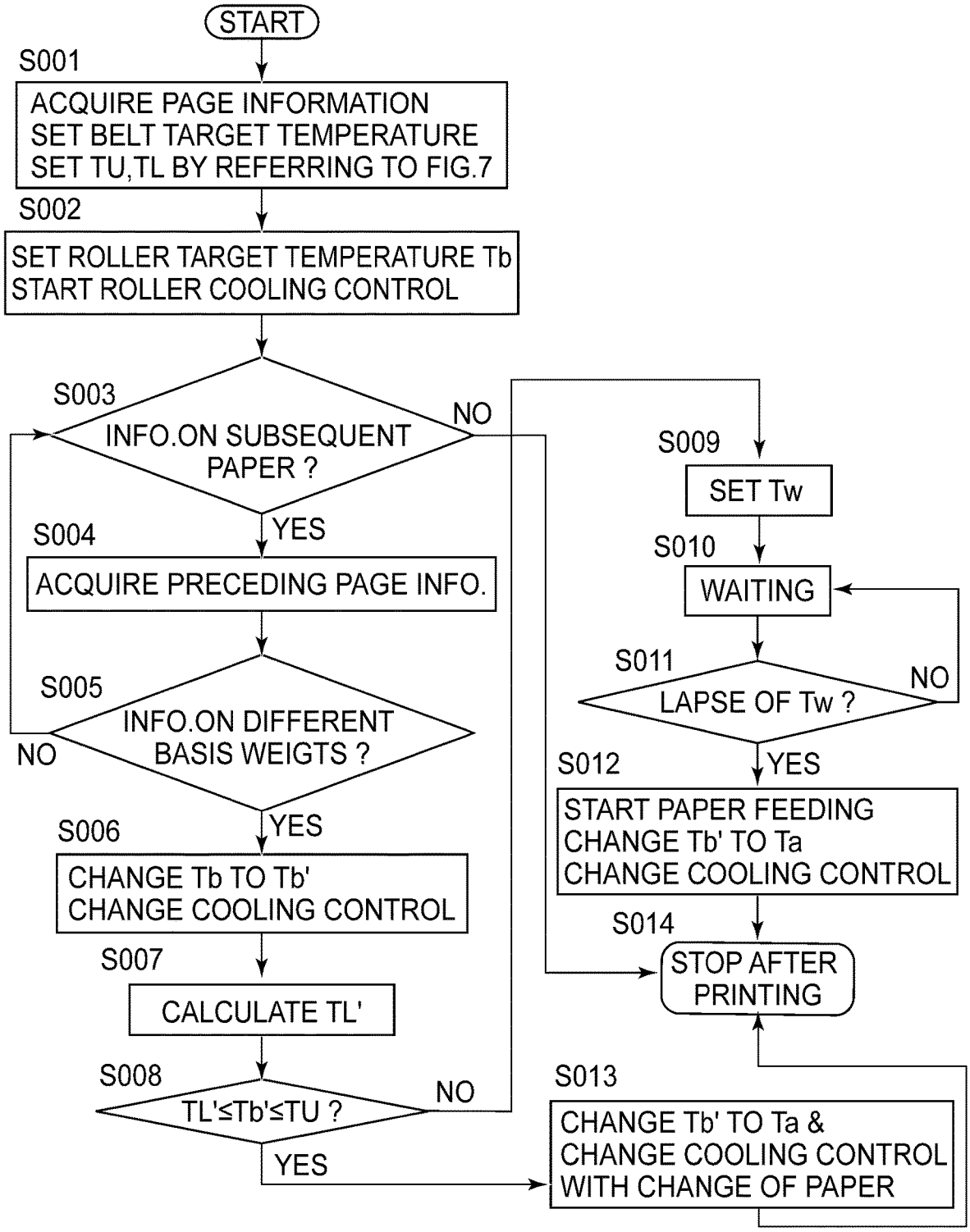
FIG. 18 is a flowchart in the Third Embodiment.

In FIG. 18, a control flowchart of this embodiment is shown.

(S001)

When the main assembly controller 120 (FIG. 5) receives a printing job signal, the page information acquiring means 107 (FIG. 5) acquires page information on the recording paper, and the control circuit portion (FIG. 5) sets the upper limit temperature TU and the lower limit temperature TL of the target temperature range of the pressing roller.

(S002)

The control circuit portion 100 (FIG. 5) sets the target temperature Tb by making reference to the upper limit temperature TU and the lower limit temperature TL, and starts cooling control of the pressing roller.

(S003)

In the case where page information on the subsequent paper exists, the sequence goes to S004. In the case where the page information on the subsequent paper does not exist, the sequence goes to S013.

(S004)

During printing, the page information acquiring means 107 (FIG. 5) acquires the page information on the subsequent recording paper.

(S005)

In the case where the preceding page information includes information on a basis weight of the recording paper different from a basis weight of the recording paper used during current printing, the sequence goes to S006. In the case where the preceding page information includes the information on the different basis weight of the recording paper, the sequence goes to S003.

(S006)

The control circuit portion 100 (FIG. 5) changes the pressing roller target temperature to Tb' and thus change pressing roller cooling control. As described above, the pressing roller temperature can be increased by weakening the output of the cooling fan or by turning off the cooling fan under control of the operation of the cooling fan. Incidentally, the pressing roller temperature can be decreased by strengthening the output of the cooling fan.

(S007)

From the continuous print number of sheets acquired in advance by the page information acquiring means 107 (FIG. 5), the control circuit portion 100 (FIG. 5) calculates the corrected lower limit temperature TL'.

(S008)

In the case where Tb' is included between the upper limit temperature TU and the lower limit temperature TL of the pressing roller target temperature range for the subsequent paper, the sequence goes to S013, and in the case where Tb' is not included between the upper limit temperature TU and the lower limit temperature TL', the sequence goes to S009.

(S009)

The recording paper feeding interval changing portion 108 (FIG. 5) determines a waiting time (Tw) during the recording paper switching by making reference to FIG. 13.

(S010)

The predetermined feeding interval changing portion 108 (FIG. 5) starts waiting in the waiting time (Tw) at the time of an end of printing of the images on the preceding recording paper.

(S011)

When the waiting time Tw elapses, the sequence goes to S012.

(S012)

Feeding of the subsequent paper is started, and the control circuit portion 100 (FIG. 5) changes the pressing roller target temperature to Ta and thus changes the pressing roller cooling control, so that the sequence goes to S014.

(S013)

The cooling control is premised on the case where Tb' is not included between the upper limit temperature TU and the lower limit temperature TL of the pressing roller target temperature range for the subsequent sheets of paper.

In this case, in synchronism with timing of switching of the kind of the recording paper passing through the fixing device, the control circuit portion 100 (FIG. 5) changes the pressing roller target temperature to Ta, and thus changes the pressing roller cooling control.

(S014)

The control is ended after the images are printed on all the sheets of recording paper (recording materials).

In the above, the Second Embodiment in which as the target temperature of the pressing roller, the upper or lower limits is set, in which the information on the subsequent paper is acquired in advance in the case where different sheets of recording paper are used in mixture and then the pressing roller target temperature is changed before the recording paper is switched. In addition thereto, this embodiment in which the waiting time during the recording material switching is determined by correcting the pressing roller target temperature depending on the continuous print number of sheets of the subsequent paper was described. As a result, in this embodiment, the waiting time during the recording paper switching is remarkably shortened, and it is possible to compatibly realize an improvement of productivity and suppression (prevention) of image defects when the different sheets of the recording paper are used in mixture.

Incidentally, in the case where the basis weight difference is small and where possible, it is preferable that the recording paper is switched with no waiting time as in the First Embodiment.

Further, in the above-described embodiments, during the passing of the final (one) sheet of the recording material in the current job, the pressing roller target temperature was changed on the basis of the recording material information in the job (subsequent job) after the recording material switching. However, the present invention is not limited thereto, and during passing of an n-th sheet (n>2) from the final sheet of the recording material of the current job, the pressing roller target temperature may also be changed on the basis of the recording material information in the job (subsequent job) after the recording material switching. That is, as regards the sheets from the n-th sheet to the final sheet of the recording materials in the current job, a rotatably pressing member target temperature different from those of the first sheet to an (n+1)-th sheet from the final sheet of the recording materials in the current job within a range in which there is no influence on a fixing property may also be employed.

Fourth Embodiment

In the following, as an embodiment of the present invention, Fourth Embodiment different the above-described First to Third Embodiments will be described. Incidentally, constituent elements similar to those of the above-described embodiments will be omitted from description by adding thereto the same reference numerals or symbols.

(Job Information Processing Portion)

Figure 19:
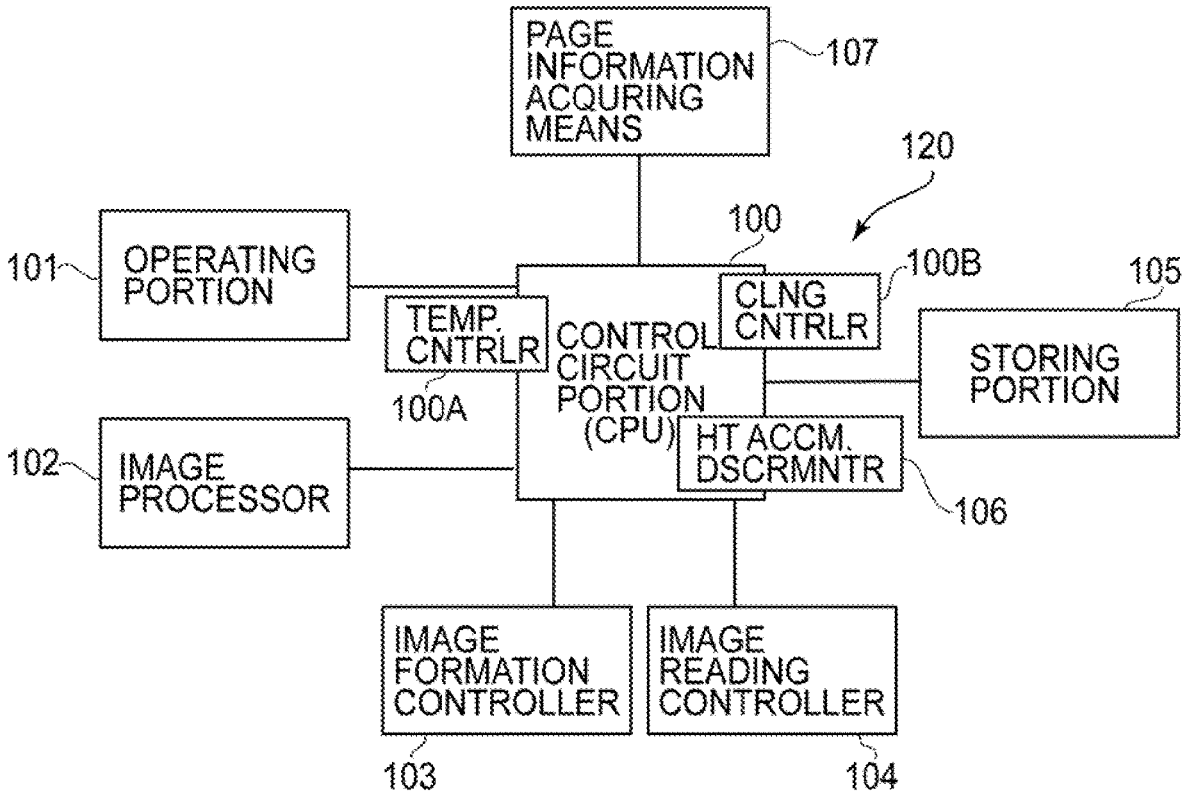
FIG. 19 is a block diagram of a main assembly controller in an image forming apparatus in which a fixing device according to Fourth Embodiment is mounted.

FIG. 19 is a block diagram of a main assembly controller 120 in the image forming apparatus. The main assembly controller 120 includes the control circuit portion (CPU) 100, an operating portion 101, an image processing portion 102, an image formation controller 103, an image reading controller 104 and a storing portion 105. Further, the main assembly controller 120 includes, as recording material information acquiring means, a page information acquiring means 107 for acquiring at least a basis weight (only the basis weight or the basis weight and the number of continuous sheets) and a recording paper feeding interval changing portion 108. Further, the control circuit portion 100 includes a temperature controller (first controller) 100A, a cooling controller (second controller) 100B and a heat accumulation state discriminating portion 106.

The control circuit portion 100 executes principally a program. The operating portion 101 is electrically connected to the controller 100, and receives input from the user. The image processing portion 102 is electrically connected to the control circuit portion 100 and processes image information from the image reading portion 1 or image information on PDL image. The image formation controller 103 is electrically connected to the control circuit portion 100 and controls the image forming portion of the image forming apparatus. The image reading controller 104 is electrically connected to the control circuit portion 100 and controls the image reading portion. The storing portion 105 is electrically connected to the control circuit portion 100 and constitutes a temporarily storing means for processing.

Further, the page information acquiring means 107 acquires setting information on the print number of a job, a so-called "basis weight mixed job" in which printing is carried out while continuously switching the basis weight of the recording paper, and the like, on the basis of information on a printing job inputted by the user. That is, the page information acquiring means 107 acquires information on the basis weight of the recording paper to be used in the printing job, the number of continuous sheets of the recording paper with the basis weight and the order of printing for each of basis weights. The information acquired by the page information acquiring means 107 is transmitted to the control circuit portion 100.

The printing job inputted to the control circuit portion 100 is sent to the storing portion 105, into which the basis weight information or the like of the recording paper on which the image is to be printed has been stored. As a result, the control circuit portion 100 is capable of acquiring input indicating that the recording paper on which the image is formed by the image forming portion 200 and is fixed by the fixing device 6 is changed to recording paper with which basis weight after printing of what number of sheets and that what number of sheets of the recording paper with the same basis weight continues subsequently to the change. Specifically, the control circuit portion 100 is capable of acquiring information such that a page on which the image is currently printed is 300 g/m$^2$ in basis weight, and after 30 pages, the recording paper with a basis weight of 60 g/m$^2$ is fed to the fixing device.

Incidentally, in this embodiment, for simplicity, the case where a basis weight mixed job is inputted as a single printing job will be described, but the case as described below also exists. The case where when a printing job A in which printing is carried out only on recording paper with a first basis weight and a printing job B which is different from the printing job B and in which the printing is carried out only on recording paper with a second basis weight are continuously inputted, these two printing jobs are continuously outputted as in a single basis weight mixed job exists.

Also in such a case, the page information acquiring means 107 sends input to the control circuit portion 100 on the basis of information on the printing jobs A and B inputted from the user. The control circuit portion 100 is capable of acquiring information indicating that the recording paper on which the image is formed at the image forming portion 200 and is fixed at the fixing device 6 is changed to recording paper with what basis weight after what number of sheets and that what number of sheets of the recording paper with the same basis weight are continuous subsequently to the change.

Incidentally, the page information acquiring means 107 may also acquire information on a material of the recording paper in addition to the basis weight. The information on the material of the recording paper is information indicating that the recording paper is, for example, plain paper, coated paper, an OHP sheet or a label. Further, as an example of information on respective pages acquired by the page information acquiring means 107, a toner print ratio on the recording paper, a toner printing portion in a recording paper surface and the like are cited.

A copying machine or the like used in on-demand printing has a productivity precedence mode in which productivity is regarded as important, and for example, as regards plain paper and coated paper, a fixing operation is carried out at the same control temperature even in different basis weights. In this embodiment, control is carried out so that a fixing temperature of the fixing belt 13 is 180° C. in terms of a surface temperature.

Further, the recording paper feeding interval changing portion 108 controls an interval (sheet interval) between respective sheets of recording paper on the basis of sheet feeding timing information received from the control circuit portion 100.

(Blister Occurrence Condition)

An occurrence condition of a blister when sheets of recording paper with a basis weight of 68 g/m$^2$ (Canon CS680 A4, hereinafter abbreviated as 68 gsm), are passed through the fixing device in condition that the surface temperature of the fixing belt is fixed at 180° C. as a predetermined temperature and the surface temperature of the pressing roller is changed was checked. A degree of an occurrence of the blister was classified into three eye-observation ranks consisting of rank 3 in which no blister occurred, rank 2 in which the blister slightly occurred, and rank 1 in which the blister remarkably occurred. A result thereof is shown in Table 1.

TABLE 1

| Pressing roller temp. | Rank of blister |
|---|---|
| 70° C. | Rank 3 |
| 80° C. | Rank 3 |
| 90° C. | Rank 3 |
| 100° C. | Rank 2 |
| 110° C. | Rank 1 |

(Discrimination of Heat Accumulation State of Pressing Roller)

Figure 20:
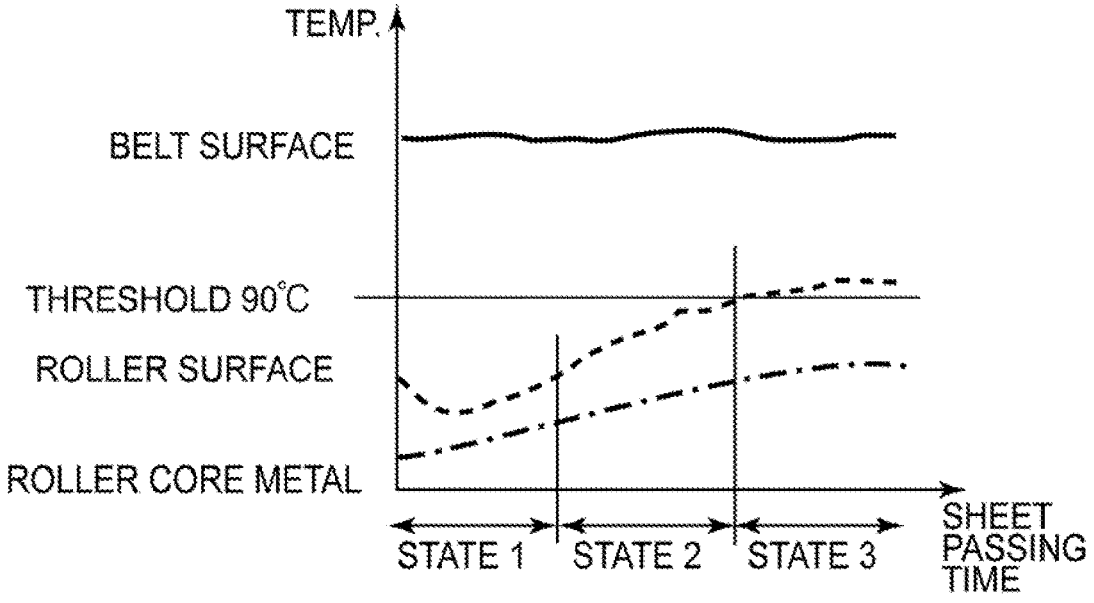
FIG. 20 is a graph for illustrating a temperature change during thin paper passing as a current job in the Fourth Embodiment.

FIG. 20 shows a time change (passing time change) of a surface temperature of the pressing roller 20 and a surface temperature of the fixing belt when sheets of 68 g paper (basis weight: 68 gsm) are continuously passed through the fixing device as a current job (job 1). As shown in FIG. 20, a state in which the pressing roller surface temperature changes depending on a heat accumulation state of the pressing roller (inner temperature such as a core metal temperature) is confirmed.

FIG. 20 relates to thin paper with a small basis weight as the recording material, but in the case of thick paper with a large basis weight as the recording material, the pressing roller core metal temperature is substantially equal to the pressing roller core metal temperature shown in FIG. 20, while the pressing roller surface temperature is a value lower than a value of the pressing roller surface temperature shown in FIG. 20.

Figures 21, 22:
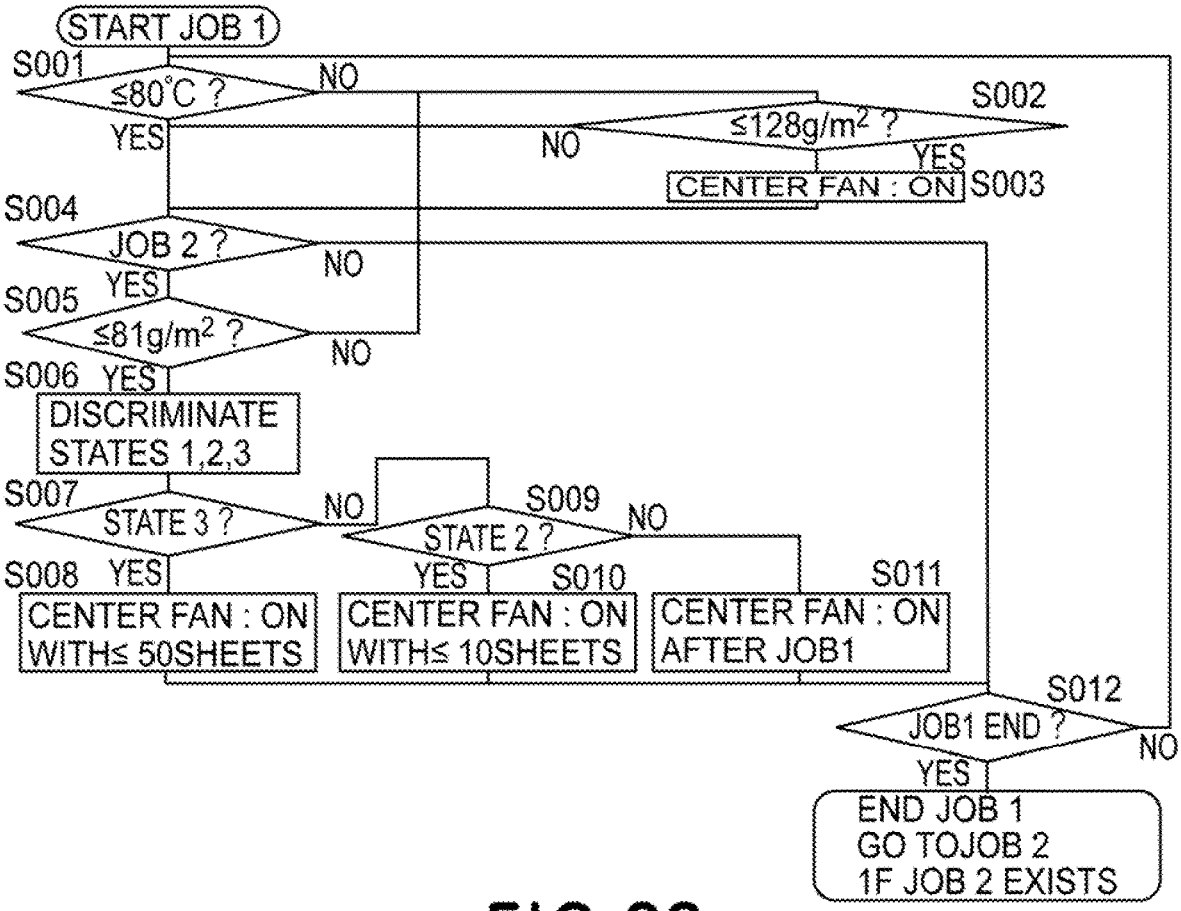
FIG. 21 is a table showing heat accumulation states of a pressing roller in the Fourth Embodiment.
FIG. 22 is a flowchart of cooling control in the Fourth Embodiment.

In FIG. 20, a heat accumulation state level in the case where the pressing roller surface temperature is 60° C. or less (the core metal temperature is 35° C. (or less) is a heat accumulation state 1, a heat accumulation state level in the case where the pressing roller surface temperature is about 60-85° C. (the core metal temperature is about 40-60° C.) is a heat accumulation state 2, and a heat accumulation state level in the case where the pressing roller surface temperature is 85° C. or more (the core metal temperature is 60° C. or more) is a heat accumulation state 3. Here, as regards the core metal temperature, the core metal is not provided with a temperature detecting element in general. Therefore, in this embodiment, discrimination of the heat accumulation state of the pressing roller by the heat accumulation state discriminating portion 106 (FIG. 19) is predicted from the pressing roller surface temperature and the basis weight of sheets of the recording paper passed through the fixing device at that time, and a relationship therebetween is shown in FIG. 21.

In order to enhance accuracy of heat accumulation discrimination, various methods in which the core metal temperature of the pressing roller is measured, in which the heat accumulation state is predicted from an output of a means for detecting a cumulative number of passing sheets of the recording materials, and in which the heat accumulation state is discriminated on the basis of a temperature after the pressing roller surface temperature exceeds a lowermost point temperature would be considered.

(Relationship Between Cooling of Pressing Roller and Non-Sheet-Passing-Portion Temperature Rise)

In the following, the influences on the fixing belt ("BELT") and the pressing roller ("ROLLER") in each of the case where the pressing roller is cooled by energizing the fans 31(*b*) and 31(*c*) which are central fans during sheet passing of 300 g paper (basis weight: 300 gsm) (after energization) and the case where the pressing roller is not cooled (before energization) will be described using FIG. 23. For simplicity, a heat generation distribution with respect to a longitudinal direction is regarded as being uniform. Further, as regards a belt temperature distribution, in a passing region (sheet passing region) in which the recording material (recording paper) passes through the fixing device, the temperature is controlled to a predetermined temperature irrespective of cooling or no cooling of the pressing roller.

Here, for example, sheets of the 300 g paper are continuously passed through the fixing device with productivity of 80 sheets per (one) minute in a certain heat accumulation state. At this time, when electric power of 3300 W is applied with respect to the longitudinal direction and a heat generation width is 330 mm, electric power consumption is 10 W per (one) mm.

Figure 23:
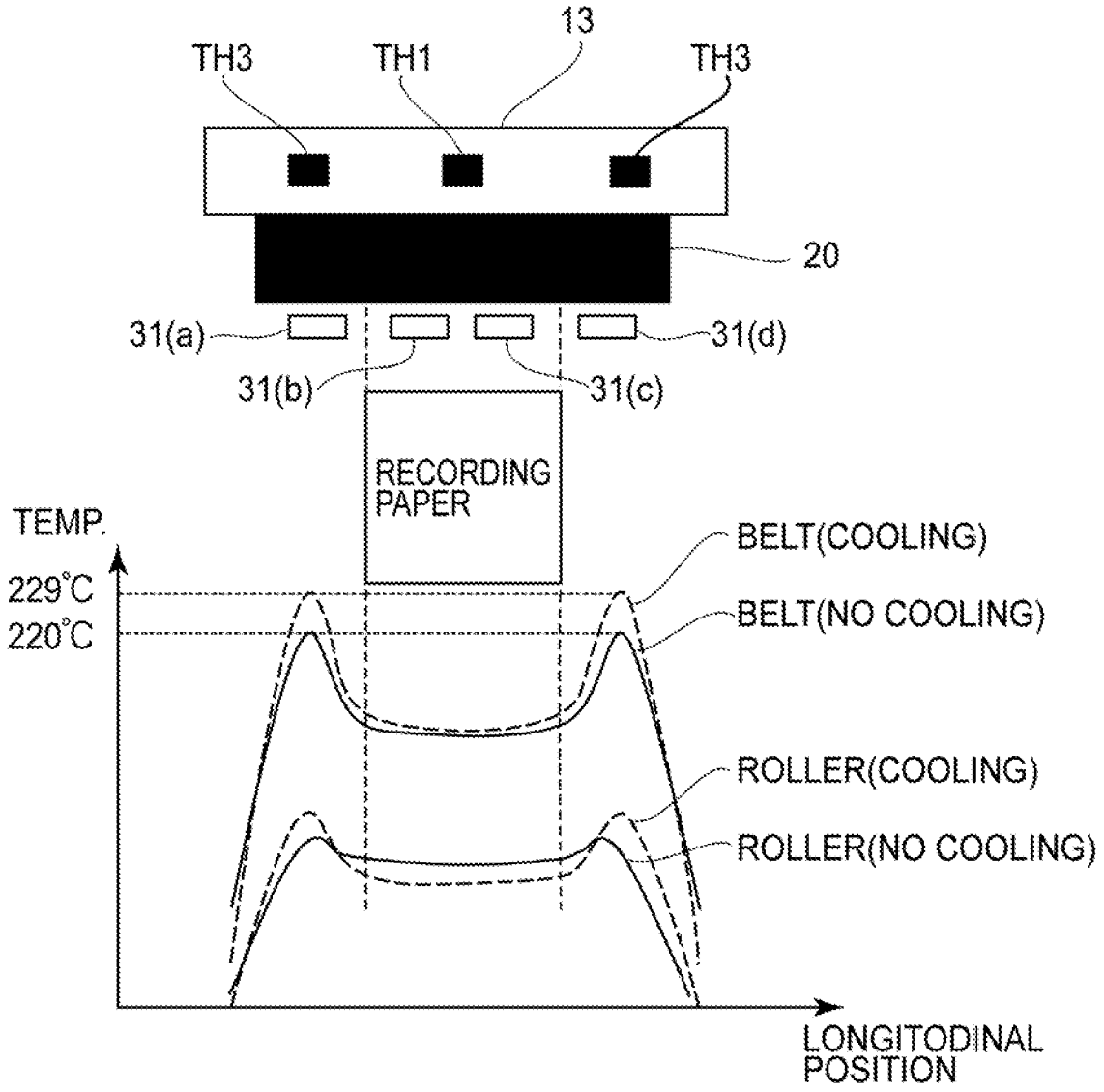
FIG. 23 is a schematic view showing a longitudinal temperature distribution during thick paper passing in the Fourth Embodiment.

At this time, longitudinal temperature distributions of the fixing belt ("BELT") 13 and the pressing roller ("ROLLER") 20 when 50 sheets of the 300 g paper are passed through the fixing device with no cooling are indicated by solid lines in FIG. 23, so that a non-sheet-passing-portion temperature (average temperature of TH3 and TH4) is 220° C.

On the other hand, when the sheet passing is made while continuously (always) energizing (cooling) the fans 31(*b*) and 31(*c*) with a start of a job in order to meet thin paper, for example, electric power of 3600 W larger than 3300 W with respect to the longitudinal direction is applied, so that electric power consumption is 11 W per mm. This is because the sheet passing region of the pressing roller 20 is cooled and therefore the temperature of the fixing belt 13 cannot be maintained until the electric power in a larger amount is supplied. As a result, the longitudinal temperature distributions of the fixing belt 13 and the pressing roller 20 when 50 sheets of the 300 g paper are passed through the fixing device are indicated by broken lines in FIG. 23.

That is, the sheet passing region temperature of the pressing roller lowers as indicated by the broken line, but the non-sheet-passing-region temperature (average temperature of TH3 and TH4) of the fixing belt 13 is 229° C., higher than 220° C., as indicated by the broken line.

As a result, it is understood that when cooling of the sheet passing region of the pressing roller by the fans 31(*b*) and 31(*c*) is blindly carried out irrespective of contents of a current job (job 1) and a subsequent job (job 2), it rather leads to an increase in non-sheet-passing-portion temperature rise of the fixing belt 13.

On the other hand, when the sheet passing region of the pressing roller is not cooled in advance, control cannot meet the case where thin paper job is inputted suddenly as the subsequent job (job 2), so that there is a possibility that the waiting time due to the cooling generates and thus productivity lowers. Therefore, there is a need that the recording material information in the subsequent job is acquired in advance and the cooling is made so as to reduce the waiting time between jobs while minimizing the cooling of the sheet passing region of the pressing roller depending on its information.

(Control Flow)

(Control During Use of Sheets of Recording Paper in Mixture)

In the following, temperature control of the pressing roller in a mixed job in which sheets of recording paper with different basis weights are successively fed (used) will be described. In the fixing device 6 in this embodiment, in the case where the recording paper to be used in a fixing process is changed from recording paper with a large basis weight to recording paper with a small basis weight, the pressing roller temperature is set at a pressing roller temperature suitable for the recording paper with the small basis weight at the time of a start of the fixing process of the recording paper with the small basis weight. Specifically, the pressing roller temperature is started to be decreased without waiting an end of the fixing process of the recording paper with the large basis weight (during execution of the preceding job).

Here, a job in which the recording paper with the large basis weight is subjected to the fixing process in advance is referred to as a preceding job, and a job in which the recording paper with the small basis weight is subjected to the fixing process subsequently to the preceding job is referred to as a subsequent job. These jobs may be a part of a single basis weight mixed job and may also be considered as a first job and a second job in the case where separate jobs are continuously inputted in a short time.

Thus, in this embodiment, the case where a first mixed job in which the preceding job for fixing the images on a plurality of sheets of recording materials with a first basis weight and the subsequent job for fixing the images on a plurality of sheets of recording materials with a second basis weight smaller than the first basis weight is a premise.

Further, in this embodiment, on the basis of the information on the subsequent recording material for which the kind of the recording material is switched and on the heat accumulation state of the second rotatable member, cooling start timing of the cooling means is controlled before the kind of the recording material is switched. Specifically, the cooling start timing of the cooling means is controlled so that the temperature of the non-sheet-passing region, in the first rotatable member, where the recording material does not pass is suppressed and so that the cooling is made earlier with a higher heat accumulation state of the second rotatable member.

In the following, this embodiment will be described using, as an example, a job in which after passing of 100 sheets of recording paper with a basis weight of 300 g/m$^2$ (Canon GF-C300 A4), hereinafter abbreviated as 300 g paper through the fixing device, 5 sheets of 68 g paper as the subsequent recording paper are passed through the fixing device. Further, no toner was placed on the 300 g paper, but the toner was placed in an application amount of 1.0 mg/cm$^2$ on an entire A4-size surface of the 68 g paper.

Further, in a comparison example 3, the sheet passing region of the pressing roller is cooled after surface passing of the 300 g paper is ended and then the sheets of the 68 g paper are passed through the fixing device. Further, in a comparison example 4, the sheet passing region of the pressing roller is always cooled during the sheet passing of the 300 g paper. Then, this embodiment (Embodiment 2) in which the sheet passing region of the pressing roller is cooled on the basis of the above-described heat accumulation states and the comparison example s 3 and 4 are compared with each other.

Here, a control flow of this embodiment is as shown in FIG. 22. First, a job is started by receiving a job 1. In the case where the surface temperature of the pressing roller 20 is higher than 80° C. (NO of S001) and the basis weight of the recording paper is 128 g/m$^2$ or less (YES of S002), the fans 31(*b*) and 31(*c*) are energized (S003). In the case where the surface temperature of the pressing roller 20 is 80° C. or less (YES of S001) or the basis weight of the recording paper is larger than 128 g/m$^2$ (NO of S002), the fans 31(*b*) and 31(*c*) are not energized. In this embodiment, in the job 1, the sheets of the 300 g paper are used, and therefore, the fans 31(*b*) and 31(*c*) are not energized.

Then, in the case where a job 2 is received during printing in the job 1 (S004), whether or not the basis weight in the job 2 is a predetermined value or less, specifically 81 g/m$^2$ or less is discriminated (S005). Then, when the basis weight in the job 2 is 81 g/m$^2$ or less, the heat accumulation state is discriminated (S006). In this embodiment, the sheets of the 68 g paper are used in the job 2, and therefore, the sequence of the control goes to the discrimination of the heat accumulation state (S006).

The discrimination of the heat accumulation state at this time is made on the basis of a table of FIG. 21. The sheets of the 300 g paper are used in the job 1 and the surface temperature of the pressing roller increases up to only 55° C., and therefore, the heat accumulation state is discriminated as the heat accumulation state 2. Accordingly, in S007, the heat accumulation state is discriminated that the heat accumulation state is not the heat accumulation state 3, and in S009, the heat accumulation state is discriminated as the heat accumulation state 2, and therefore, energization to the fans 31(*b*) and 31(*c*) is started when a remaining number of sheets of the recording paper in the job 1 is 10 sheets or less.

When the heat accumulation state is the heat accumulation state 3, the sequence goes to S008, and the energization to the fans 31(*b*) and 31(*c*) is started when the remaining number of sheets of the recording paper in the job 1 is 50 sheets or less. Further, when the heat accumulation state is the heat accumulation state 1, the sequence goes to a step of S011 (the energization to the fans 31(*b*) and 31(*c*) is started after the job 1). Thereafter, when an end signal of the job 1 is received (S012), the job 1 is ended and the sequence goes to the job 2.

Figures 24, 25:
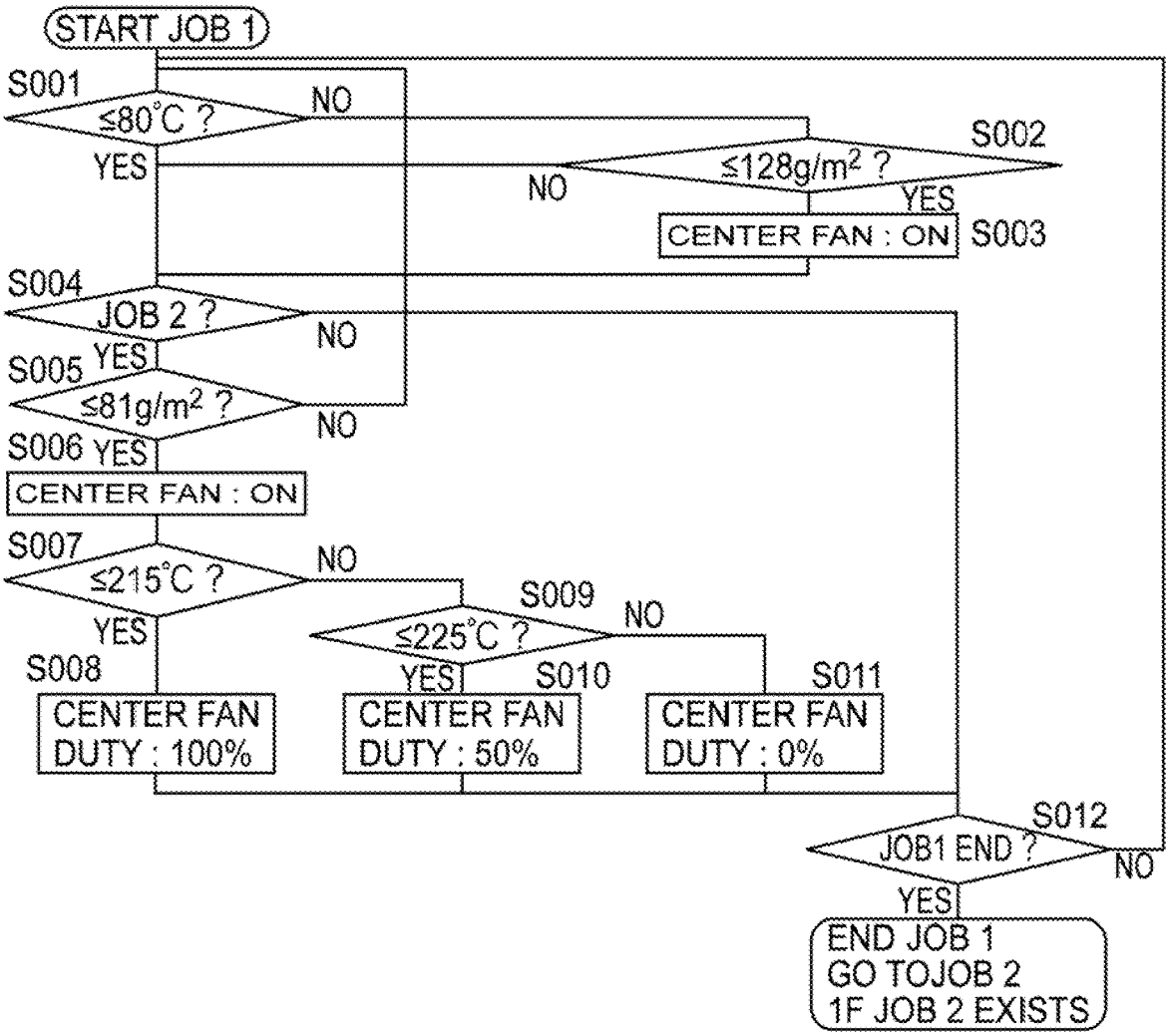
FIG. 24 is a table for illustrating an effect of the Fourth Embodiment.
FIG. 25 is a flowchart of cooling control in Fifth Embodiment.

A result thereof is shown in FIG. 24. FIG. 24 shows the non-sheet-passing-portion temperature (average temperature of TH3 and TH4) of the fixing belt at the time of a current job (job 1) in each of the comparison example 3, the comparison example 4 and this embodiment (Embodiment 2). Further, FIG. 24 shows a blister rank of 5 sheets of the 68 g paper passed through the fixing device in a subsequent job (job 2) in each of the comparison example 3, the comparison example 4 and this embodiment (Embodiment 2).

As regards the non-sheet-passing-portion temperature (rise) at the time of the end of the job 1, results of 222° C. in the comparison example 3, 237° C. in the comparison example 4 which is largely deteriorated, and 225° C. in Embodiment 2 which is comparable to the comparison example 3 were acquired. Next, as regards the blister rank of the job 2, in the comparison example 3, the rank 2 and the rank 1 are conspicuous, whereas in Embodiment 2, similarly as in the comparison example 4, all the blister ranks are the rank 3 and thus a good result was acquired. As a result, it turned out that in Embodiment 2, the good result of the blister was obtained for the sheets of the 68 g paper in the job 2 while suppressing the non-sheet-passing-portion temperature rise to the extent possible during the sheet passing of the sheets of the 300 g paper in the job 1.

Fifth Embodiment

As regards control of a timewise element in the cooling means, in the Fourth Embodiment, control of cooling start timing for which the heat accumulation state of the pressing roller is taken in consideration was described. In this embodiment, control of a duty ("DUTY") as a cooling period of the fans for which the non-sheet-passing-portion temperature of the fixing belt is taken into consideration will be described. Other points are similar to those in the above-described embodiments and therefore will be omitted from description.

As described above, the blind cooling of the sheet passing region of the pressing roller rather leads to a problem of the non-sheet-passing-portion temperature rise of the fixing belt.

Therefore, in this embodiment, a cooling performance is controlled by providing a plurality of threshold temperatures to a detection temperature of the non-sheet-passing portion of the fixing belt and by controlling the duty as the cooling period in cooling of the sheet passing region of the pressing roller.

A control flow of this embodiment is as shown in FIG. 25. First, a job is started by receiving a current job (job 1). In the case where the surface temperature of the pressing roller 20 is higher than 80° C. (S001) and the basis weight of the recording material in a subsequent job (job 2) is 128 g/m$^2$ or less (S005), the fans 31(*b*) and 31(*c*) which are central fans are energized (S003). In the case where the surface temperature of the pressing roller 20 is 80° C. or less (S001) or the basis weight of the recording paper is larger than 128 g/m$^2$ (S002), the fans 31(*b*) and 31(*c*) are not energized, and the sequence goes to S004. In this embodiment, in the job 1, the sheets of the 300 g paper are used, and therefore, the fans 31(*b*) and 31(*c*) are not energized, and the sequence goes to S004.

Then, in the case where the subsequent job (job 2) is received during printing in the current toner (job 1) (S004), whether or not the basis weight in the job 2 is 81 g/m$^2$ or less is discriminated (S005). Then, when the basis weight in the job 2 is 81 g/m$^2$ or less, the fans 31(*b*) and 31(*c*) are energized, and the pressing roller 20 is cooled (S006). However, depending on a value of the non-sheet-passing-portion temperature rise (average temperature of TH3 and TH4), the duty of the fans 31(*b*) and 31(*c*) is changed.

As a result, in the case where the non-sheet-passing-portion temperature is larger than a predetermined value, the duty of the fans 31(*b*) and 31(*c*) is decreased (lowered or shortened), so that processing can be carried out in a small waiting time even when the subsequent (next) job is a thin paper job, while suppressing a problem of the non-sheet-passing-portion temperature rise. That is, first, whether or not the non-sheet-passing-portion temperature (average temperature of TH3 and TH4) is 215° C. or less is discriminated (S007), and in the case of 215° C. or less, the duty of the fans 31(*b*) and 31(*c*) is set at 100% (S008).

In the case where the non-sheet-passing-portion temperature is not 215° C. or less, whether or not the non-sheet-passing-portion temperature (average temperature of TH3 and TH4) is larger than 215° C. and is 225° C. or less is discriminated (S009), and when the non-sheet-passing-portion temperature is a value therebetween, the duty of the fans 31(*b*) and 31(*c*) is set at 50% (S010). In S009, when the non-sheet-passing-portion temperature (average temperature of TH3 and TH4) is discriminated as being larger than 225° C., the duty of the fans 31(*b*) and 31(*c*) is set at 0% (i.e., the fans are turned off) (S011).

As a result, in the case where the non-sheet-passing-portion temperature is larger than the predetermined value, by carrying out control of decreasing (lowering) the duty of the fans 31(*b*) and 31(*c*), within a range in which a problem of the non-sheet-passing-portion temperature rise is aggravated, processing can be made with a small waiting time even when the next job is the thin paper job.

The cooling start timing in this embodiment may be the same as that of the Fourth Embodiment and may also be always certain cooling start timing (fixed cooling start timing).

Modified Embodiments

In the above-described embodiments, the preferred embodiments of the present invention were described, but the present invention is not limited thereto and can be variously modified within the scope of the present invention.

In the above-described embodiments, as regard the control of the timewise element in the cooling means, the subsequent job may also be not only the case of the thin paper with a small basis weight but also the case where the thin paper is used together with paper (thick paper) other than the thin paper in mixture. Further, the subsequent recording material may be not the recording material used in the subsequent job but may also be the recording material used in the case where different recording materials are used in mixture in the same job (current job).

Further, in the Fourth Embodiment, the cooling start timing may also be controlled depending on the basis weight and the continuous print number of sheets continuously passed through the fixing device (whether a large number of sheets of the thin paper continuously pass through the nip or a small number of sheets of the thin paper continuously pass through the nip). (In this case, earlier timing is set with an increasing number of the sheets.)

In the above-described Fourth Embodiment, as regards the heat accumulation state of the pressing roller, discrimination thereof on the basis of the surface temperature of the sheet passing region of the pressing roller and discrimination thereof on the basis of the cumulative number of sheets passed through the fixing device were described, but the heat accumulation state of the pressing roller may also be discriminated on the basis of the surface temperature of the sheet passing region of the pressing roller and a gradient of rise of the surface temperature (time rate of change).

In the above-described embodiments, as the rotatable pressing member, the pressing roller was described, but the rotatable pressing member may also be a rotatable pressing belt extended around and stretched by a plurality of pulleys as disclosed in JP-A Hei 11-194647.

Further, in the above-described embodiments, the heater 11 was provided as the heating member for heating the nip, but the present invention is not limited thereto. For example, the rotatable fixing belt 13 may also be caused to generate heat by electromagnetic induction heating using an exciting coil or by energization.

Further, in the above-described embodiments, the recording paper was used as the recording material, but the recording material in the present invention is not limited to the paper. In general, the recording material is a sheet-like member on which the toner image is to be formed by the image forming apparatus, and includes, for example, regular or irregular plain paper, thick paper, thin paper, an envelope, a postcard, a seal, a resin sheet, an OHP sheet, glossy paper, and the like. In the above-described embodiments, for convenience, as regards treatment of the recording material (sheet) P, description was made using terms such as the sheet (paper) passing and the sheet (paper) feeding, but by this, the recording material in the present invention is not limited to the paper.

In the above-described embodiments, the fixing device for fixing the unfixed toner image on the sheet was described as an example, but the present invention is not limited thereto. The present invention is similarly applicable to a device (apparatus) for heating and pressing a toner image tentatively fixed on the sheet in order to improve gloss (glossiness) of an image (also in this case, the device is referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2018-110234 filed on Jun. 8, 2018 and 2018-110235 filed on Jun. 8, 2018, which are hereby incorporated by reference herein in their entirety.

What is claimed is:

1. An image heating apparatus for heating an image on a recording material, comprising:

a fixing member including a heating portion and configured to fix a toner image on the recording material in contact with the toner image formed on the recording material;

a pressing member configured to form a nip in cooperation with said fixing member;

a fan configured to cool said pressing member; and a controller configured to control an operation of said fan, wherein a temperature of said pressing member when the image is formed on a recording material having a first basis weight is lower than a temperature of said pressing member when the image is formed on a recording material having a second basis weight larger than the first basis weight, wherein when a mixed job including a first image forming step for continuously forming images on recording materials having the first basis weight and including a second image forming step, subsequent to the first image forming step, for continuously forming the images on recording materials having the second basis weight is executed, said controller switches, before a final recording material in the first image forming step completely passes through the nip, the operation of said fan to an operation of said fan for making the temperature of said pressing member higher than the temperature of said pressing member when the images are formed on the recording materials having the first basis weight.

2. An image heating apparatus according to claim 1, wherein the mixed job is a single job for performing the first image forming step and the second image forming step.

3. An image heating apparatus according to claim 1, wherein the mixed job comprises a single job including the first image forming step and a single job including the second image forming step.

4. An image heating apparatus according to claim 1, wherein said controller controls the operation of said fan so that the temperature of said pressing member falls within a range set in advance.

5. An image heating apparatus according to claim 1, further comprising a temperature detecting member for detecting the temperature of said pressing member substantially at a central portion with respect to a longitudinal direction of said pressing member, wherein said controller controls the operation of said fan on the basis of an output of said temperature detecting member.

6. An image heating apparatus according to claim 1, wherein when the temperature of said pressing member does not reach a temperature on the basis of the recording material passed through said image heating apparatus at a time of an end of the first image forming step, said controller does not perform the second image forming step and adjusts the temperature of said pressing roller for starting the second image forming step.

7. An image heating apparatus according to claim 1, wherein said controller stepwise makes the temperature of said pressing member higher than the temperature of said pressing member when the images are formed on the recording materials having the first basis weight.

8. An image heating apparatus according to claim 1, wherein said pressing member is heated by said fixing member.

9. An image heating apparatus for heating an image on a recording material, comprising:

a fixing member including a heating portion and configured to fix a toner image on the recording material in contact with the toner image formed on the recording material;

a pressing member configured to form a nip in cooperation with said fixing member;

a fan configured to cool said pressing member; and a controller configured to control an operation of said fan, wherein a temperature of said pressing member when the image is formed on a recording material having a first basis weight is lower than a temperature of said pressing member when the image is formed on a recording material having a second basis weight larger than the first basis weight, wherein when a mixed job including a first image forming step for continuously forming images on recording materials having the second basis weight and including a second image forming step, subsequent to the first image forming step, for continuously forming the images on recording materials having the first basis weight is executed, said controller switches, before a final recording material in the first image forming step completely passes through the nip, the operation of said fan to an operation of said fan for making the temperature of said pressing member lower than the temperature of said pressing member when the images are formed on the recording materials having the second basis weight.

10. An image heating apparatus according to claim 9, wherein the mixed job is a single job for performing the first image forming step and the second image forming step.

11. An image heating apparatus according to claim 9, wherein the mixed job comprises a single job including the first image forming step and a single job including the second image forming step.

12. An image heating apparatus according to claim 9, wherein said controller controls the operation of said fan so that the temperature of said pressing member falls within a range set in advance.

13. An image heating apparatus according to claim 9, further comprising a temperature detecting member for detecting the temperature of said pressing member substantially at a central portion with respect to a longitudinal direction of said pressing member, wherein said controller controls the operation of said fan on the basis of an output of said temperature detecting member.

14. An image heating apparatus according to claim 9, wherein when the temperature of said pressing member does not reach a temperature on the basis of the recording material passed through said image heating apparatus at a time of an end of the first image forming step, said controller does not perform the second image forming step and adjusts the temperature of said pressing roller for starting the second image forming step.

15. An image heating apparatus according to claim 9, wherein said controller stepwisely makes the temperature of said pressing member lower than the temperature of said pressing member when the images are formed on the recording materials having the first basis weight.

16. An image heating apparatus according to claim 9, wherein said pressing member is heated by said fixing member.

17. An image heating apparatus for heating an image on a recording material, comprising:

a fixing member including a heating portion and configured to fix a toner image on the recording material in contact with the toner image formed on the recording material;

a pressing member configured to form a nip in cooperation with said fixing member;

a fan configured to cool said pressing member; and a controller configured to control an operation of said fan, wherein a temperature of said pressing member when the image is formed on a recording material having a first basis weight is lower than a temperature of said pressing member when the image is formed on a recording material having a second basis weight larger than the first basis weight, wherein when during execution of a first image forming job for continuously forming images on recording materials having the second basis weight, a second image forming job, executed subsequently to the first image forming job, for continuously forming the images on recording materials having the first basis weight is received, on the basis of a temperature of said pressing member when the second image forming job is received, said controller selects, before a final recording material in the first image forming step completely passes through the nip, whether or not an operation of said fan for making the temperature of said pressing member lower than the temperature of said pressing member when the images are formed on the recording materials having the second basis weight should be executed.

18. An image heating apparatus according to claim 17, wherein the first basis weight is a predetermined value or less.

19. An image heating apparatus according to claim 17, wherein when during execution of a first image forming job for continuously forming images on recording materials having the second basis weight, a second image forming job, executed subsequently to the first image forming job, for continuously forming the images on recording materials having the first basis weight is received, on the basis of a temperature of said pressing member when the second image forming job is received and on a cumulative number of times of formation of the images formed in the first image forming step when the second image forming job is received, said controller selects, before a final recording material in the first image forming step completely passes through the nip, whether or not an operation of said fan for making the temperature of said pressing member lower than the temperature of said pressing member when the images are formed on the recording materials having the second basis weight should be executed.

20. An image heating apparatus according to claim 17, wherein when the temperature of said pressing member is smaller than a set value, said controller does not execute the operation of said fan for making the temperature of said pressing member lower than the temperature of said pressing member when the images are formed on the recording materials having the second basis weight, before the final recording material in the first image forming step completely passes through the nip, and when the temperature of said pressing member is larger than a set value, said controller executes, before the final recording material in the first image forming step completely passes through the nip, the operation of said fan for making the temperature of said pressing member lower than the temperature of said pressing member when the images are formed on the recording materials having the second basis weight.

* * * * *